United States Patent [19]

Hirai

[11] Patent Number: 4,820,622

[45] Date of Patent: Apr. 11, 1989

[54] HEAT DEVELOPMENT IMAGE FORMING METHOD

[75] Inventor: Hiroyuki Hirai, Kanagawa, Japan

[73] Assignee: Fuji Photo Film Co., Ltd., Kanagawa, Japan

[21] Appl. No.: 179,448

[22] Filed: Apr. 8, 1988

[30] Foreign Application Priority Data

Apr. 8, 1987 [JP] Japan ..... 62-86123

[51] Int. Cl.[4] ..... G03C 5/54

[52] U.S. Cl. ..... 430/351; 430/203

[58] Field of Search ..... 430/203, 351

[56] References Cited

U.S. PATENT DOCUMENTS 4,500,626 2/1985 Naito et al. ..... 430/203

4,740,446 4/1988 Schranz et al. ..... 430/203

*Primary Examiner*—Richard L. Schilling

*Attorney, Agent, or Firm*—Sughrue, Mion, Zinn, Macpeak & Seas

[57] ABSTRACT

An image is formed by imagewise exposing a heat-developable photosensitive material comprising (a) a photosensitive silver halide, (b) a reducing agent or a precursor thereof, (c) a dye-providing substance which forms or releases a diffusible dye in proportion or counter-proportion to the reduction of the silver halide into silver, and (d) a binder on a support, during or after the imagewise exposure of the photosensitive material, maintaining the photosensitive material in such a pH and a temperature lower than the heat-developing temperature for a predetermined time that the reaction between the silver halide and the reducing agent preferentially takes place rather than the reaction of forming or releasing a diffusible dye, and thereafter heat developing the exposed material in the presence of a base and/or a base precursor to imagewise produce a diffusible dye.

7 Claims, No Drawings

HEAT DEVELOPMENT IMAGE FORMING METHOD

BACKGROUND OF THE INVENTION

This invention relates to an image forming method, and more particularly, to a method for forming an image by forming or releasing a diffusible dye in an alkaline atmosphere.

A variety of proposals have been made in the art for producing dye images through heat development. Among them, the most interested method capable of separating dye images from silver images in a simple, but complete manner is by using a dye-providing substance which forms or releases a diffusible dye through heat development and diffusing the diffusible dye into a dye-fixing or image-receiving element under the influence of heat and/or solvent to produce a dye image. Reference is made to U.S. Pat. Nos.

| | | |
|---|---|---|
| 4,463,079 | 4,474,867 | 4,478,927 |
| 4,483,914 | 4,507,380 | 4,500,626 |

Japanese patent application Kokai Nos.

| | | |
|---|---|---|
| 58-149046 | 58-149047 | 59-152440 |
| 59-154445 | 59-165054 | 59-180548 |
| 59-168439 | 59-174832 | 59-174833 |
| 59-174834 | 59-174835 | 61-238056 |
| and EP 210660A. | | |

These prior art well-known methods for forming dye images through heat development, however, suffer from poor image discrimination in that a dye image available is rather stained and has a relatively low density.

One system uses a dye-providing substance in combination with a reducing agent. The reaction between the reducing agent or an oxidized form thereof and the dyereducing providing substance is utilized to form an imagewise distribution of a diffusible dye. In this case, an image is often obtained at a lower density than expected probably because a latent image is injured during heat development. In another system, a reducing agent is oxidized imagewise, and a dye-providing substance is reacted with that portion of the reducing agent which is left in a reverse-imagewise pattern to produce a positive imagewise distribution of a diffusible dye. Under high-temperature conditions during heat development, however, there is no substantial difference in reaction rate between the reaction of the silver halide or organic silver salt with the reducing agent and the reaction of the dye-providing substance with the reducing agent. Then, the reducing agent can react with the dye-providing substance to produce a diffusible dye even in an area where the silver halide is developed.

SUMMARY OF THE INVENTION

It is, therefore, an object of the present invention to provide a method capabale of forming a dye image with minimized fog and stain at a high degree of image discrimination.

According to the present invention, there is provided a method for forming an image, comprising the steps of imagewise exposing a heat-developable photosensitive material comprising at least (a) a photosensitive silver halide, (b) a reducing agent or a precursor thereof, (c) a dye-providing substance which forms or releases a diffusible dye in proportion or counter-proportion to the reduction of the silver halide into silver, and (d) a binder on a support, during or after the imagewise exposure of the photosensitive material, maintaining the photosensitive material under such conditions for a predetermined time that the reaction between the silver halide and the reducing agent preferentially takes place rather than the reaction of forming or releasing a diffusible dye, and thereafter heat developing the exposed material in the presence of a base and/or a base precursor to imagewise produce a diffusible dye.

DETAILED DESCRIPTION OF THE INVENTION

The image forming method of the present invention uses a heat-developable photosensitive material comprising at least (a) a photosensitive silver halide, (b) a reducing agent or a precursor thereof, (c) a dye-providing substance which forms or releases a diffusible dye in proportion or in counter-proportion to the reduction of the silver halide into silver, and (d) a binder on a support. According to the present invention, during or after its imagewise exposure, the photosensitive material is maintained under such conditions for a predetermined time that the reaction between the silver halide and the reducing agent preferentially takes place rather than the reaction of forming or releasing a diffusible dye, and the exposed material is then heat developed. The conditions under which the reaction between the silver halide and the reducing agent preferentially takes place rather than the reaction of forming or releasing a diffusible dye are, in a practical sense, conditions which are at a temperature lower than the temperature above which the reaction of forming or releasing a diffusible dye occurs (this temperature is herein referred to as "heat-developing temperature") and which allow reaction to take place between the silver halide and the reducing agent. The conditions which allow reaction to take place between the silver halide and the reducing agent mean that the pH and temperature of a photosensitive layer of the heat-developable photosensitive material are controlled at a sufficient level to allow reaction to take place between the silver halide and the reducing agent.

As defined above, the heat-developing temperature is a temperature to be set for the reaction of the dye-providing substance forming or releasing a diffusible dye. The temperature lower than the heat-developing temperature is preferably a temperature lower by at least 10° C. than the heat-developing temperature, more preferably a temperature lower by at least 15° C. than the heat-developing temperature. A temperature variation within this range is permissible.

The pH of a photosensitive layer is at least 8, preferably at least 9 as measured by adding dropwise 20 μm of water onto the layer and determining the pH in equilibrium using a planar pH electrode.

In a preferred embodiment of the present invention, image forming reaction is carried out in the presence of an auxiliary developing agent or electron transfer agent. To this end, a choice is made of the auxiliary developing agent which has higher reactivity with the silver halide than the reducing agent. The use of the auxiliary developing agent of such nature assists in the progress of reaction of the silver halide even at the pH or temperature of the photosensitive layer at which the reducing agent can otherwise react with the silver halide to a least extent. The overall process is considered as the developing reaction which proceeds in the following interacting cycle.

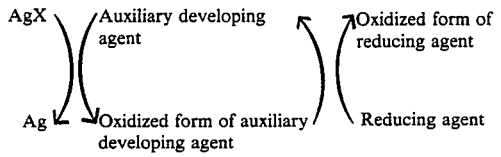

The present invention is particularly effective in an image forming system using a dye-providing substance of oxidized form wherein the dye-providing substance is reduced with a reducing agent to release a diffusible dye, because stain can be controlled by promoting developing reaction.

In this embodiment of the present invention, maintenance of the photosensitive material for a predetermined time under the above-defined conditions means to maintain the material until the amount of silver developed reaches preferably at least 5%, more preferably at least 10% of the finally available amount of silver developed. During this period, dye formation or release occurs only up to 50%, preferably up to 20% of the finally available amount of dye formed or released.

In another preferred embodiment of the present invention, an internal latent image type emulsion is combined with a nucleating agent or secondary exposure to carry out image-forming reaction. If nucleating reaction or secondary exposure is carried out at elevated temperatures, then only insufficient reversal occurs to produce a highly stained dye image having a low density. If such reaction is carried out at a temperature lower than the heat-developing temperature as in the present invention, then a dirct reversal dye image having a high S/N ratio is available. The use of an auxiliary developing agent is most preferred in this case too. The term secondary exposure used herein means that after a photosensitive emulsion is once exposed to light, an unexposed silver halide portion undergoes exposure again under the influence of light or a reducing agent and is also known as re-exposure or chemical fogging.

In this embodiment of the present invention, maintenance of the photosensitive material for a predetermined time under the above-defined condition means to maintain the material until the amount of silver developed in a Dmax area (unexposed area) reaches preferably at least 5%, more preferably about 10% of the finally available amount of silver developed.

The heating temperature used in the heat development step generally ranges from about 50° C. to about 250° C., preferably from about 80° C. to about 180° C. A step of diffusing and transferring a dye may be carried out at the same time as heat development or after completion of heat development. In the latter case, the heating temperature used in the transfer step to enable dye transfer may range from room temperature to the temperature used in the heat development, more preferably from 50° C. to a temperature which is lower by about 10° C. than the temperature used in the heat development.

Transfer of a dye can occur with the aid of heat only, although a solvent may be used to promote dye transfer.

It is also useful to heat a heat-developable photosensitive material in the presence of a minor amount of solvent, typically water to concurrently or sequentially conduct development and transfer as described in Japanese patent application Kokai Nos. 59-218443 and 61-238056. This process prefers a heating temperature in the range from 50° C. up to the boiling point of the solvent, for example, from 50° C. to 100° C. for water solvent.

Examples of the solvent used to provide for promotion of development and/or migration of a diffusible dye to a dye-fixing layer are water and aqueous basic solutions containing inorganic alkali metal salts and organic bases. (The base may be selected from the examples which will be later described in conjunction with the image formation promotor.) Also useful are low-boiling solvents and mixtures of low-boiling solvents and water or aqueous basic solutions. Such additives as a surface-active agent, an anti-fogging agent, and a complexing compound capable of complexing reaction with a difficultly soluble basic metal compound may be contained in the solvent.

These solvents may be applied to the dye-fixing material and/or photosensitive material. The amount of solvent used is as small as up to the weight of solvent corresponding to the maximum swollen volume of the overall coatings, more specifically up to the weight of solvent corresponding to the maximum swollen volume of the overall coatings minus the weight of the overall coatings.

The solvent, typically water is applied between a photosensitive layer of a heat-developable photosensitive material and a dye-fixing layer of a dye-fixing material in order to promote formation of an image and/or migration of a dye, and it may be previously incorporated in either the photosensitive and/or dye-fixing layer. A suitable method for providing the solvent to the photosensitive or dyefixing layer is described in Japanese patent application Kokai No. 61-147244, pages 26, for example.

To promote dye transfer, the photosensitive material or dye-fixing material may contain therein a hydrophilic thermal solvent which is solid at an ambient temperature, but melts at elevated temperatures to serve as solvent. The hydrophilic thermal solvent may be incorporated in the photosensitive element and/or the dye-fixing element. Although the solvent can be incorporated into any of the emulsion layer, intermediate layer, protective layer, and dye-fixing layer, it is preferred to incorporate it into the dye-fixing layer and/or layers adjacent thereto. Examples of the hydrophilic thermal solvents include ureas, pyridines, amides, sulfonamides, imides, polyhydric alcohols, oximes and other heterocyclic compounds.

A high-boiling solvent may be incorporated in the photosensitive material and/or the dye-fixing material in order to promote dye transfer.

Heating means used in the development and/or transfer step include heat blocks, irons, heat rollers, and other heating elements as described in Japanese patent application Kokai No. 61–1472244, page 24. It is also possible to provide the photosensitive material or dye-fixing material with a layer of electroconductive material such as graphite, carbon black, and metal whereby electric current is conducted to the conductive layer to directly heat the material.

The pressure under which the photosensitive and dye-fixing materials are in firm contact and application of such pressure may be in accord with the method described in Japanese patent application Kokai No. 61-147244, page 27.

In processing a photographic material according to the present invention, any desired one of various known heat developing machines may be used. Some preferred non-limiting examples of the heat developing machine are shown in Japanese patent application Kokai Nos. 59-75247, 59-177547, 59-181353, and 60-18951 and Japanese Utility Model Application No. 60-116734.

Typical of the dye-providing substances which can be used in the present invention is a two-equivalent coupler which has a non-diffusible group as an eliminatable group and is capable of coupling reaction with an oxidized form (oxidant) of reducing agent to form a diffusible dye. Illustrative examples of the couplers are described in detail in, for example, T. H. James, "The Theory of the Photographic Process", 4th Ed., pages 291–334 and 354–361, and the following laid-open specifications.

Japanese patent application Kokai NOs:

| | | |
|---|---|---|
| 58-123533 | 58-149046 | 58-149047 |
| 59-111148 | 59-124339 | 59-174835 |
| 59-231539 | 59-231540 | 60-2950 |
| 60-2951 | 60-14242 | 60-23474 |
| 60-66249. | | |

Another class of dye-providing substances includes compounds having the function of releasing or diffusing a diffusible dye imagewise. The compounds of this type may be represented by the following formula [L I]:

[L I] $(\text{Dye-X})_n\text{-Y}$ wherein Dye represents a dye group, a temporarily wavelength shortened dye group or a dye precursor group; X represents a valence bond or a connecting linkage; and Y represents a group which, in correspondence or counter-correspondence to photosensitive silver salt having a latent image distributed imagewise, produces a difference in diffusibility of the compound represented by $(\text{Dye-X})_n\text{-Y}$ or releases Dye, the diffusibility of Dye released being different from that of the compound represented by $(\text{Dye-X})_n\text{-Y}$; and n represents an integer of 1 or 2, when n=2, the Dye-X's may be the same or different.

Also useful are couplers having a diffusible dye as an eliminatable group and thus releasing a diffusible dye through reaction with an oxidant of a reducing agent, known as DDR couplers, as described in British Patent No. 1,330,524; Japanese Patent Publication No. 48-39165; U.S. Pat. No. 3,443,940 and the like.

Also useful is a dye-releasing (DRR) compound which itself has reducing nature so that it may be cross-oxidized with an oxidant of a reducing agent or auxiliary developing agent. Typical examples of these compounds are dye-providing substances described in the following publications:

| | | |
|---|---|---|
| U.S. Pat. Nos. | 3,443,939, | 3,725,062, |
| 3,728,113, | 3,928,312, | 4,053,312, |
| 4,055,428, | 4,336,322, | 4,500,626, |

Japanese patent application Kokai Nos.

| | | |
|---|---|---|
| 51-104343, | 53-3819, | 57-179840, |

-continued

| | | |
|---|---|---|
| 58-116537, | 59-65839, | 59-69839, |

Representative examples of these dye-providing substances are those compounds described in the above-incorporated U.S. Pat. No. 4,500,626, columns 22–44, most preferably the compounds identified therein as compounds (1)–(3), (10)–(13), (16)–(19), (28)–(30), (33)–(35), (38)(40), and (42)–(64). Also useful are the compounds described in Japanese patent application Kokai No. 61-124941.

Among the compounds belonging to general formula [L I], the dye-providing substances which produce a mobile dye in couter proportion to the reduction of silver ion into silver, that is, positive dye-providing substances include as typical examples (1) a dye-providing substance which is mobile under alkaline conditions and/or under heat and is cross-oxidized with an oxidant of a reducing agent into an oxidant which is non-diffusible, that is, a dye developing agent; (2) a non-diffusible dye-providing substance which itself is a reducing agent, releases a mobile or diffusible dye under alkaline conditions and/or under heat, but is cross-oxidized with an oxidant of a reducing agent into an oxidant which no longer releases a dye; and (3) a non-diffusible dye-providing substance which reacts with the remainder of a reducing agent which is left without being consumed in development, to release a mobile dye. Preferred among the dye-providing substances belonging to classes (2) and (3) are those compounds which themselves are immobilized with a well-known ballast group.

Examples of the positive dye-providing substances belonging to class (1) are dye developing agents as described in U.S. Pat. Nos. 3,134,764, 3,362,819, 3,482,972, 3,597,200, and 3,544,545 and Japanese patent Application Kokai No. 59-165054.

Examples of the positive dye-providing substances belonging to class (2) are compounds as described in Japanese patent application Kokai Nos. 49-111628, 51-63618, 52-4819, 53-69033, and 54-130927.

The positive dye-providing substances belonging to class (3) are preferably used in the practice of the present invention. Examples of the positive dye-providing substances belonging to class (3) are described in detail.

One typical example is a BEND compound as disclosed in Japanese patent application Kokai No. 53-110827. This compound undergoes an intramolecular nucleophilic substitution reaction through reduction to release a mobile dye as represented by the following simplified scheme.

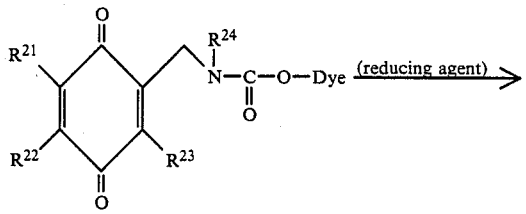

-continued

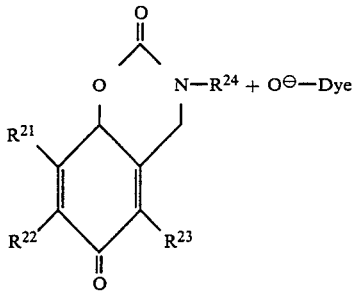

In the formulae, R21 to R24 are substituents such as alkyl groups.

Another typical example is a compound as discosed in Japanese Patent Application Kokai No. 53-110828. The nitro group of this compound which is a nucleophilic precursor undergoes an intramolecular nucleophilic substitution reaction through reduction to release a mobile dye as represented by the following simplified scheme.

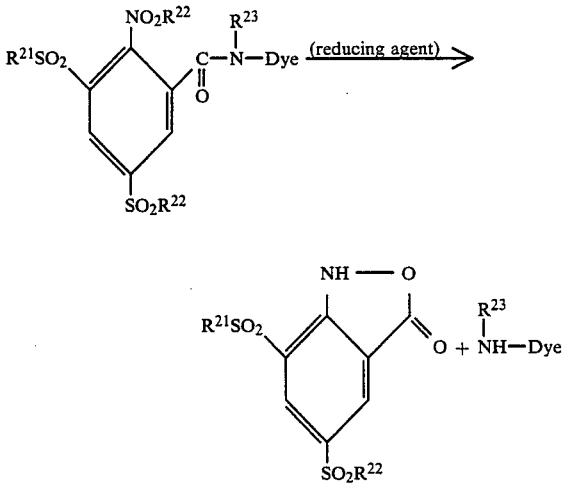

In the formulae, R21 and R22 are substituents such as alkyl groups and R23 is a substituent such as a hydrogen atom or alkyl group.

A further example is a compound as disclosed in Japanese patent application Kokai No. 56-130927. The process of this compound releasing a mobile dye is represented by the following simplified scheme.

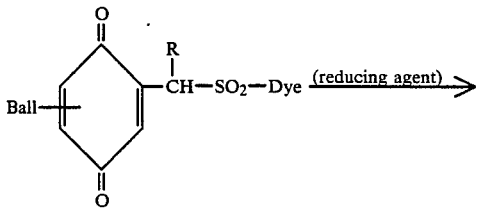

-continued

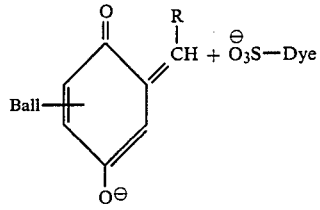

In the formulae, R is a substituent such as an alkyl group and Ball is a ballast group.

A still further example is a compound as disclosed in U.S. Pat. No. 4,444,867 and Japanese patent application Kokai No. 58-196266. The process of this compound releasing a mobile dye is represented by the following simplified scheme.

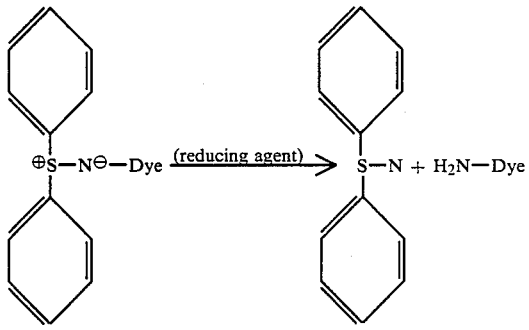

A yet further example is a compound as disclosed in Japanese patent application No. 61-88625. This compound is represented by the following general formula (C II) in which the N-X bond undergoes cleavage by reduction with a reducing agent to eventually release a mobile dye. This compound is particularly useful in the practice of the present invention.

General formula (C II)

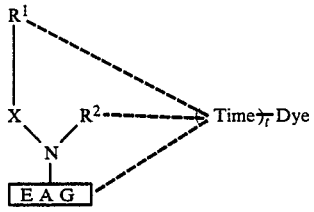

In the formula, EAG is an electron acceptor group which accepts an electron from a reducing substance;

X is a nitrogen atom, an oxygen atom or a sulfur atom;

$R^1$ and $R^2$ are substituents other than a hydrogen atom, $R^1$ or $R^2$ represents a valence bond or a divalent substituent when $R^1$ or $R^2$ is bonded to -(Time)$_t$-Dye, or $R^1$ and $R^2$ may, taken together, form a ring;

Time is a group which releases Dye through a series of reactions triggered by cleavage of the N-X bond in the formula;

Dye is a diffusible dye;

t is an integer equal to 0 or 1; and solid lines represent chemical bonds and broken lines indicate that at least one of the broken lines is bonded.

More preferred among the compounds of general formula (C II) are compounds of the following general formula (C III). General formula (C III)

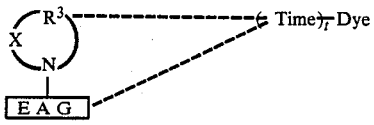

In the formula, $R^3$ is a group of atoms necessary to bond with the nitrogen atom and X to form a 3- to 8-membered monocyclic or fused heterocyclic ring;

EAG, X, Time, Dye, t, solid lines and broken lines are as defined for formula (C II).

Examples of electron acceptor group EAG are shown in Japanese patent application No. 61-88625.

Illustrative examples of EAG include aryl groups substituted with at least one electron attracting group, for example, 4-nitrophenyl group, 2-nitro-4-N-methyl-N-octadecylsulfamoylphenyl group, 2-N,N-dimethylsulfamoyl-4nitrophenyl group, 2-cyano-4-octadecylsulfonylphenyl group, 2,4-dinitrophenyl group, 2,4,6-tricyanophenyl group, 2-nitro-4-N-methyl-N-octadecylcarbamoylphenyl group, 2-nitro-5-octylthiophenyl group, b 2,4dimethanesulfonylphenyl group, 3,5-dinitrophenyl group, 2-chloro-4-nitro-5-methylphenyl group, 2-nitro-3,5-dimethyl-4-tetradecylsulfonylphenyl group, 2,4-dinitronaphthyl group, 2-ethylcarbamoyl-4-nitrophenyl group, 2,4-bis-(dodecylsulfonyl)-5-trifluoromethylphenyl group, 2,3,4,5,6-pentafluorophenyl group, 2-acetyl-4-nitrophenyl group, 2,4-diacetylphenyl group, 2-nitro-4trifluoromethylphenyl group, etc.;

substituted or unsubstituted heterocyclic groups, for example, 2-pyridyl group, 2-pyrazyl group, 5-nitro-2pyridyl group, 5-N-hexadecylcarbamoyl-2-pyridyl group, 4pyridyl group, 3,5-dicyano-2-pyridyl group, 5-dodecyl-sulfonyl-2-pyridyl group, 5-cyano-2-pyrazyl group, 4-nitrothiophen-2-yl group, 5-nitro-1,2-dimethylimidazol-4yl group, 3,5-diacetyl-2-pyridyl group, 1-dodecyl-5-carbamoylpyridinium-2-yl group, etc.;

substituted or unsubstituted quinone groups, for example, 1,4-benzoquinon-2-yl group, 3,5,6-trimethyl-1,4-benzoquinon-2-yl group, 3-methyl-1,4-naphthoquinon-2-yl group, 3,6-dimethyl-5-hexadecylthio-1,4-benzoquinon-2-yl group, 5-pentadecyl-1,2-benzoquinon-4-yl group, etc.; and vinylogs of the foregoing groups as well as nitroalkane and α-diketo groups.

Most preferred among the compounds of general formula (C III) are compounds of the following general formula (C IV).

General formula (C IV)

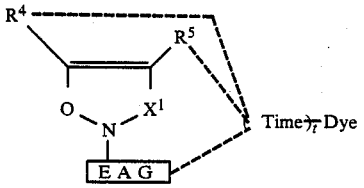

In the formula, EAG, Time, Dye, t, solid lines and broken lines are as defined for formula (C II);

$X^1$ is a divalent bridging group, most preferably

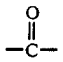

or $-SO_2-$, and $R^4$ and $R^5$ are independently hydrogen atoms or substitutable groups, or may, taken together, form a saturated or unsaturated carbocyclic or heterocyclic ring.

Preferred examples of the groups represented by $R^4$ include a hydrogen atom, a substituted or unsubstituted alkyl group such as a methyl group, ethyl group, t-butyl group, octadecyl group, phenetyl group, carboxymethyl group, etc.; a substituted or unsubstituted aryl group such as a phenyl group, 3-nitrophenyl group, 4methoxyphenyl group, 4-acetylaminophenyl group, 4methanesulfonylphenyl group, 2,4-dimethylphenyl group, 4-tetradecyloxyphenyl group, and a group of the formula:

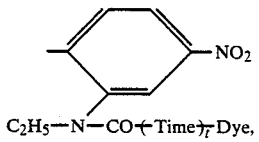

etc.; and a substituted or unsubstituted heterocyclic group such as a 2-pyridyl group, 2-furyl group, 3-pyridyl group, etc.

Preferred examples of the groups represented by $R^5$ include a hydrogen atom, a substituted or unsubstituted alkyl group such as a methyl group, hydroxymethyl group, $CH_2$-(Time)t-Dye group, etc.; a substituted or unsubstituted aryl group such as a phenyl group, 4-chlorophenyl group, 2-methylphenyl group, and groups of the formulae:

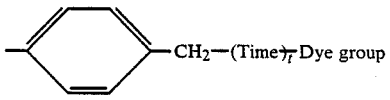

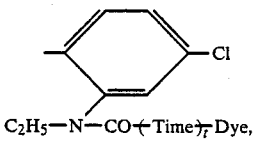

etc.; and a substituted or unsubstituted heterocyclic group such as a 4-pyridyl group etc.

Examples of $R^4$ and $R^5$ which, taken together, form a ring as part of a fused ring are given below. It is to be understood that the entire structure of the fused ring is shown herein.

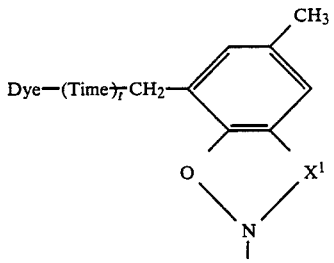

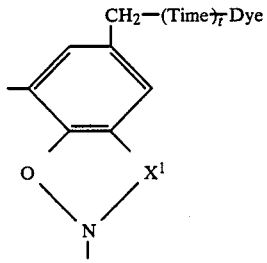

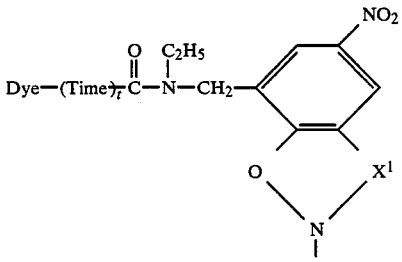

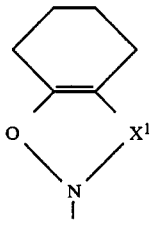

-continued

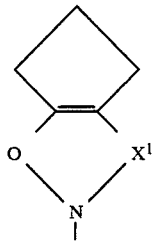

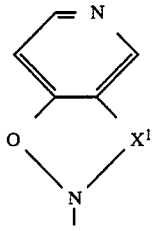

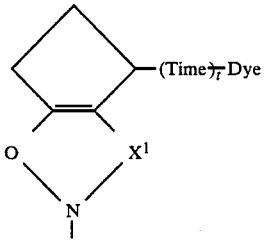

The dye-releasing moiety - $(Time)_t$-Dye is now described in detail. As defined above, Time is a group which releases Dye through a series of reactions triggered by cleavage of the N-$X^1$ bond in the formula, and t is equal to 0 or 1.

The groups represented by Time are well known in the art as described in Japanese patent application Kokai No. 61-147244, pages 5–6 and 61-236549, pages 8–14.

The dyes represented by Dye include azo dyes, azomethine dyes, anthraquinone dyes, naphthoquinone dyes, styryl dyes, nitro dyes, quinoline dyes, carbonyl dyes, phthalocyanine dyes and the like. It is to be noted that these dyes may be used in temporarily wavelength shortened form such that they can recover their color upon development. Useful dyes represented by Dye are disclosed in EP No. 76,492A and Japanese patent application Kokai No. 59-165054.

(1)

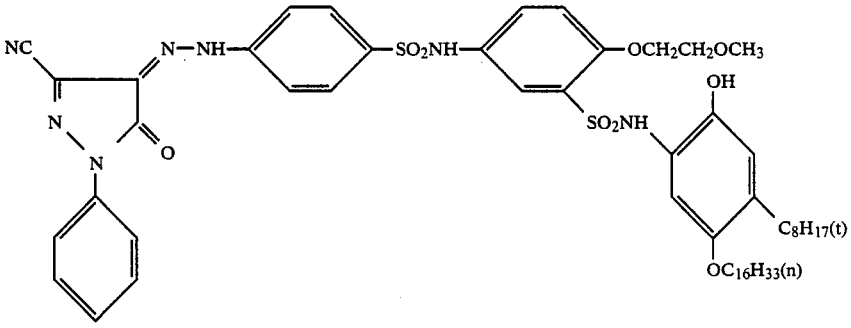

-continued
(2)
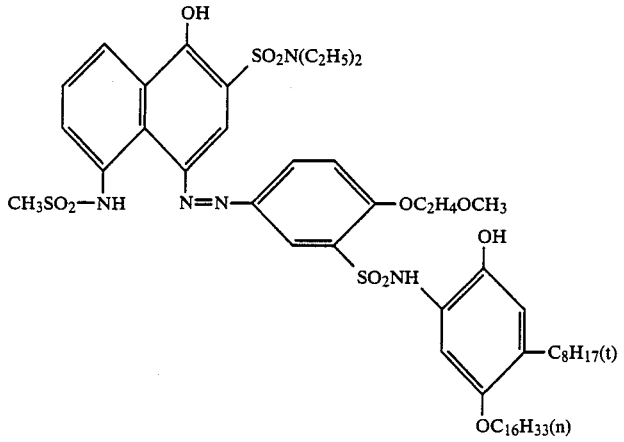
(3)
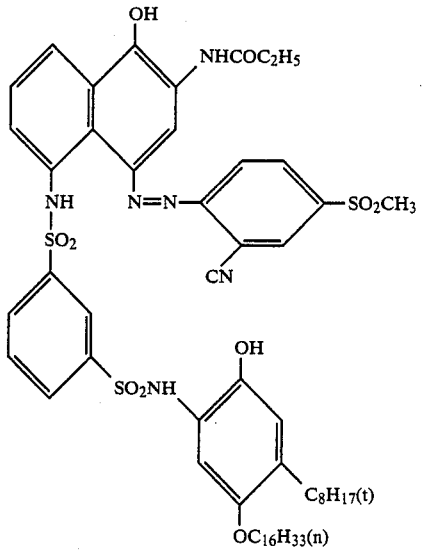
(4)
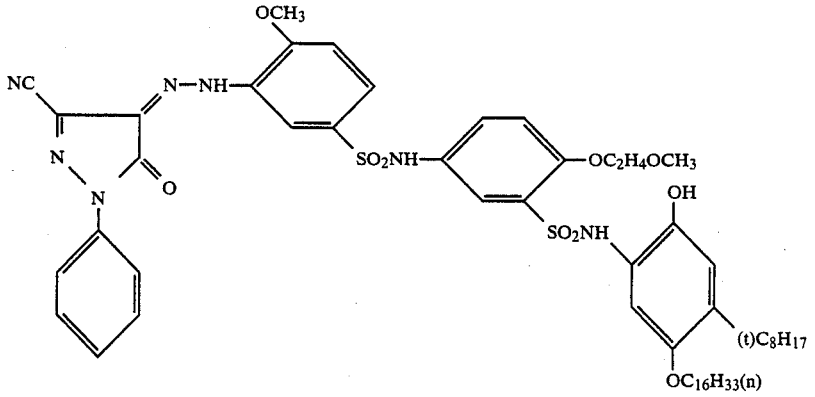
(5)
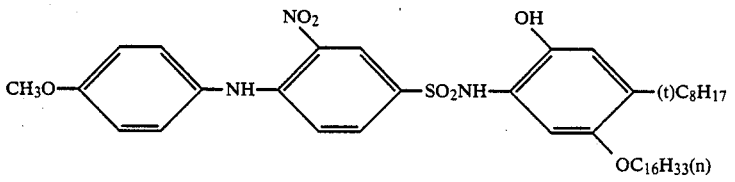

-continued
(6)
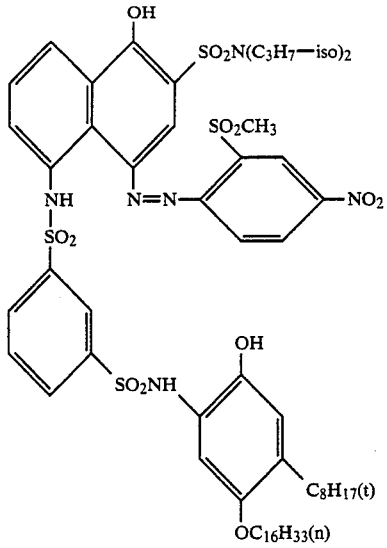
(7)
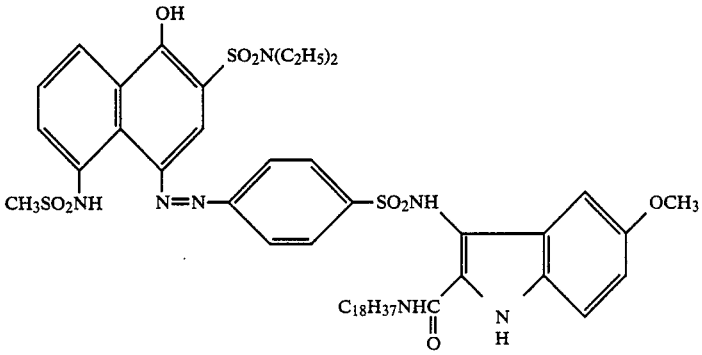
(8)
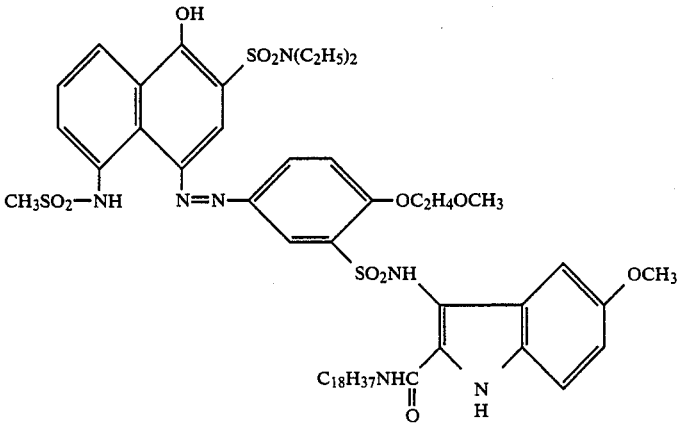

-continued
(9)
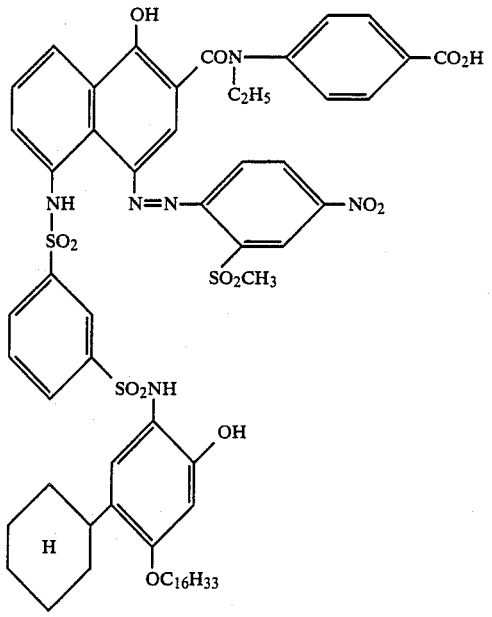
(10)
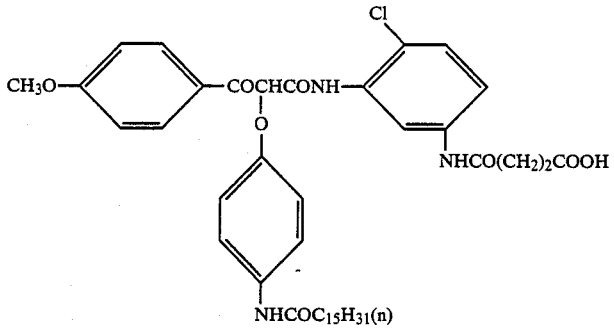
(11)
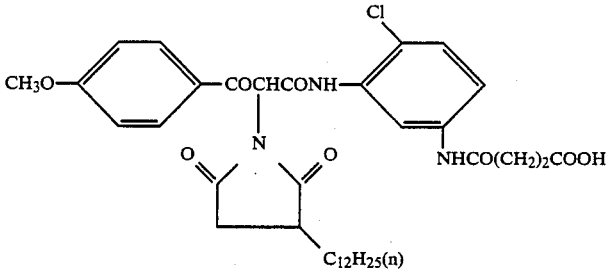
(12)
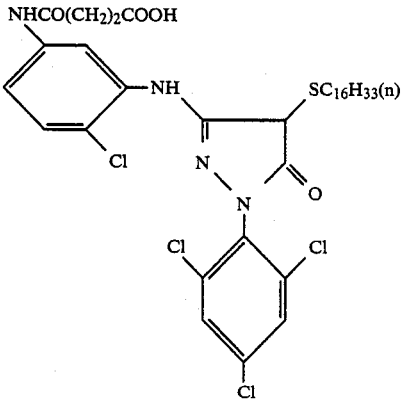

-continued
(13)
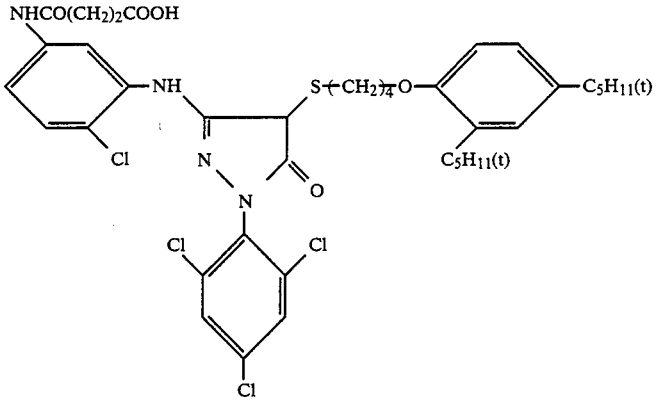
(14)
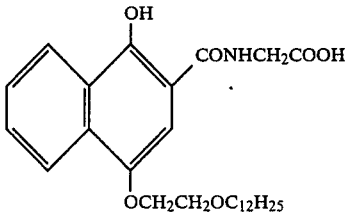
(15)
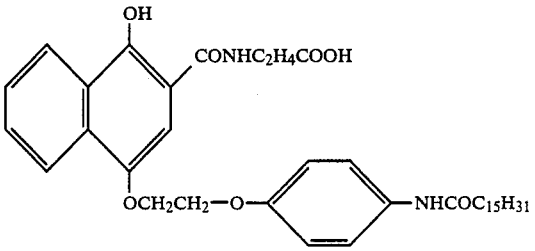
(16)
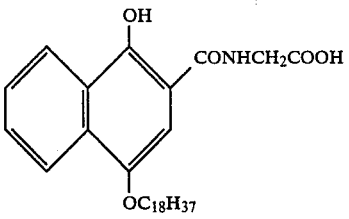
(17)
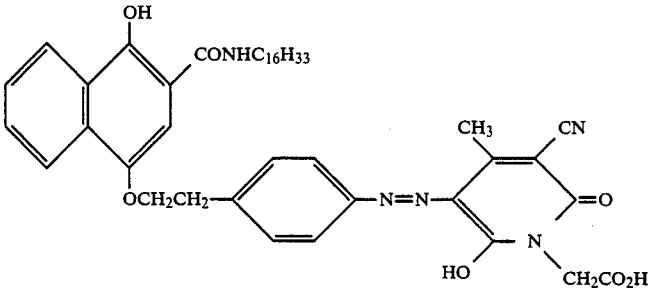

-continued
(18)
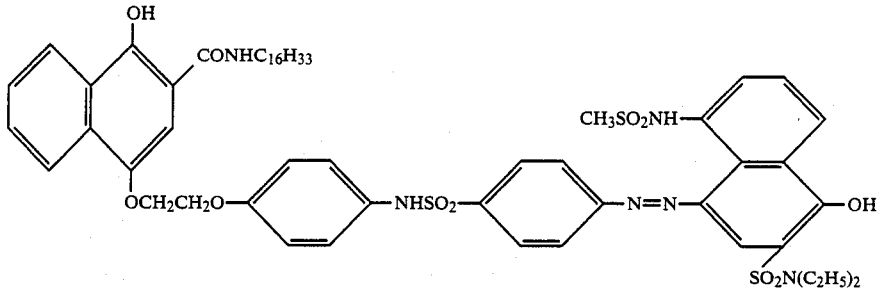
(19)
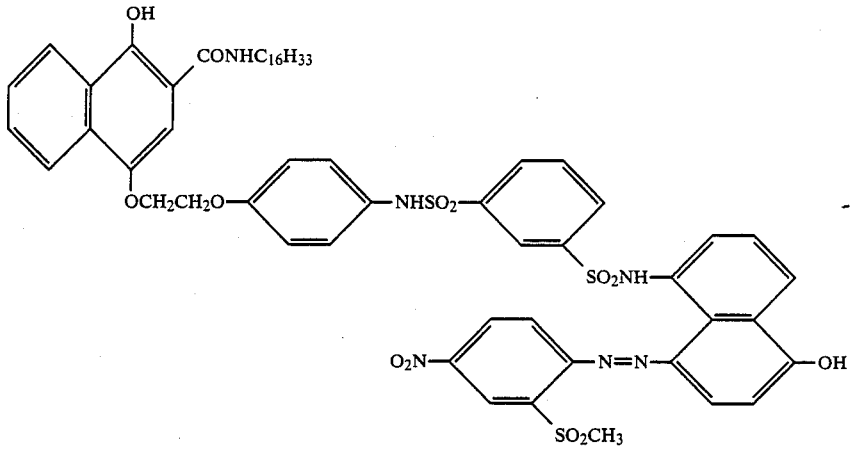
(20)
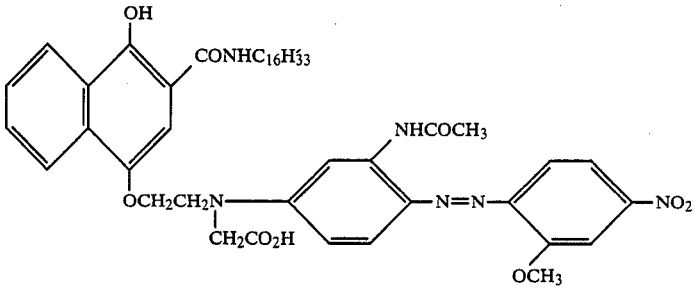
(21)
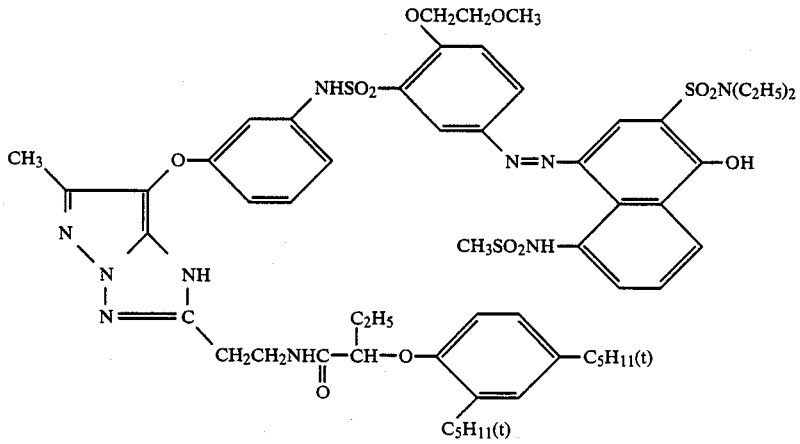

-continued
(22)
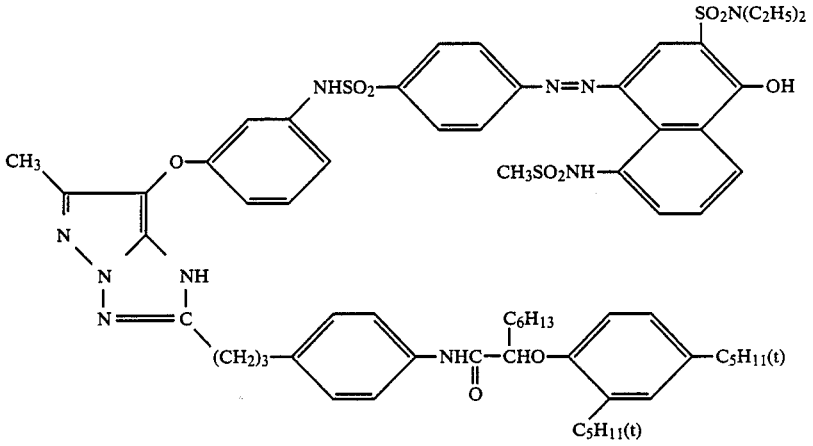
(23)
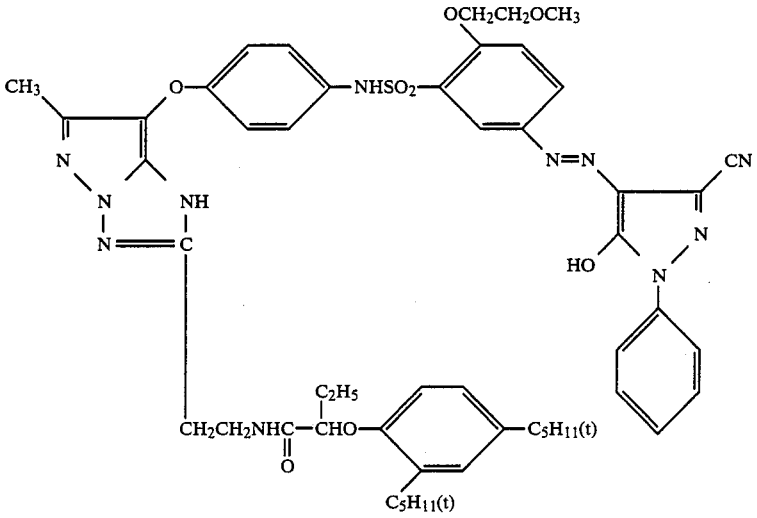
(24)
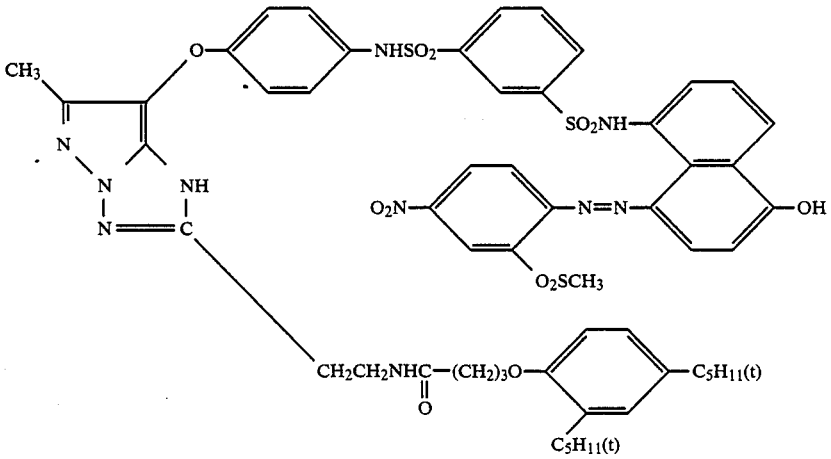

-continued
(25)
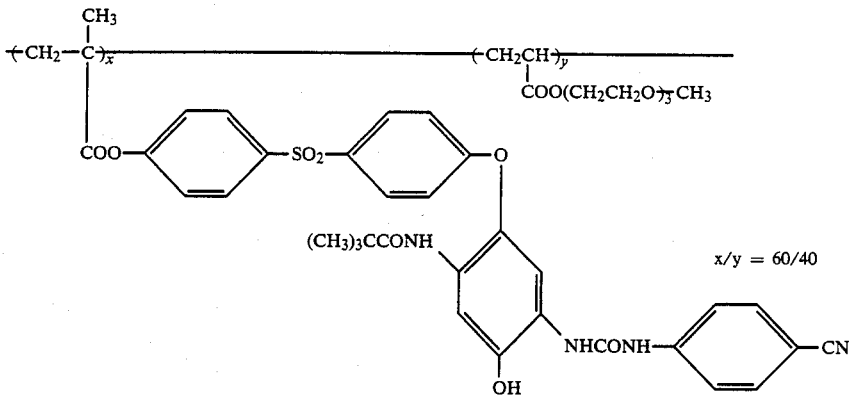
(26)
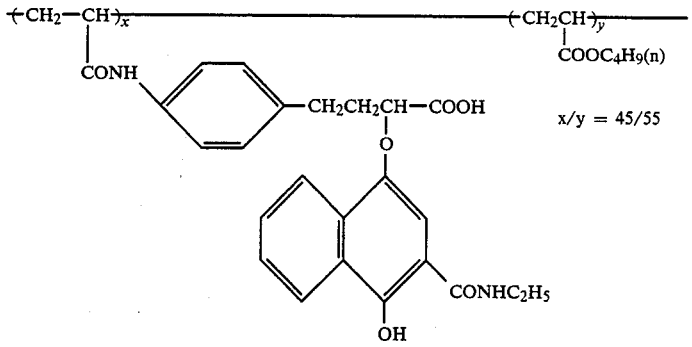
(27)
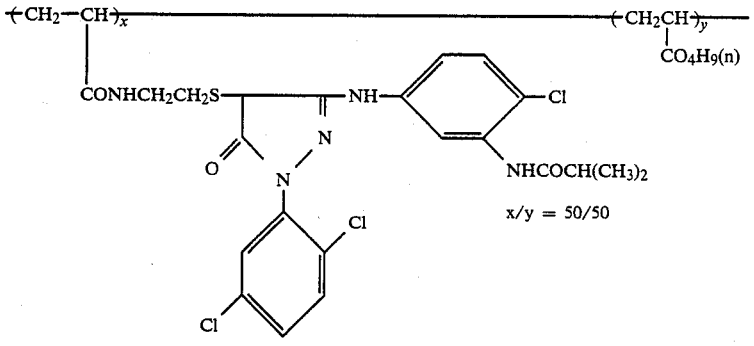
(28)
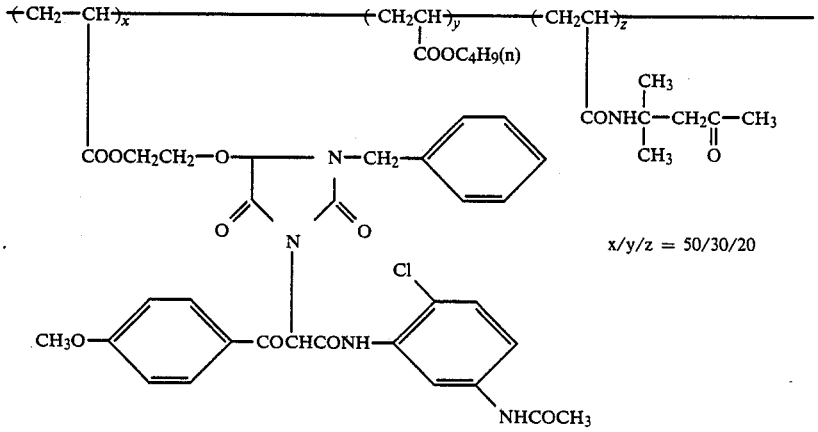

-continued
(29)
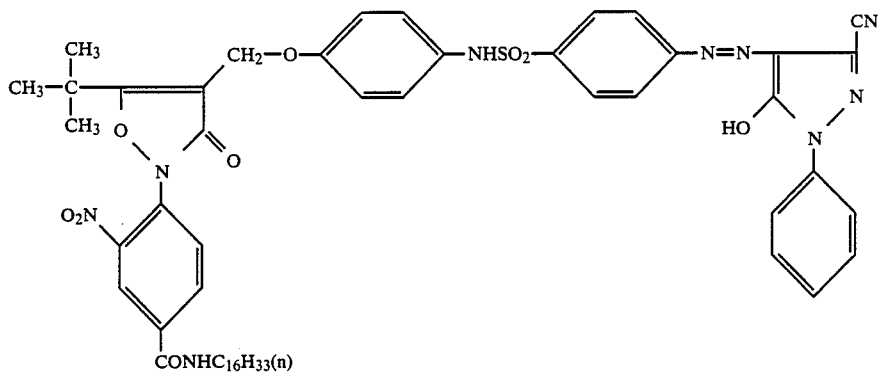
(30)
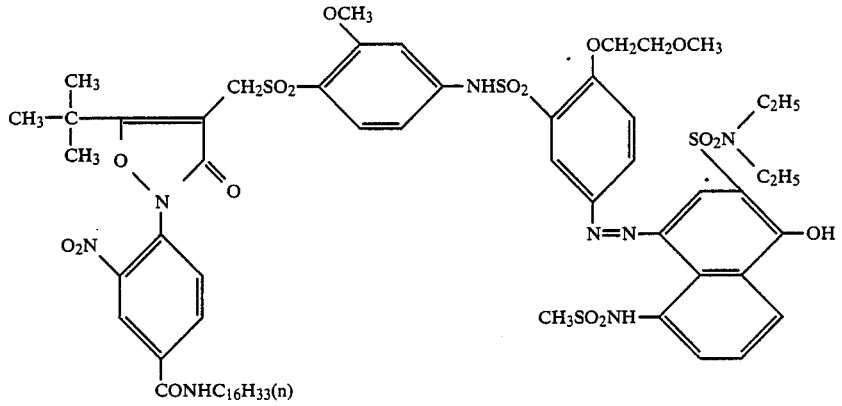
(31)
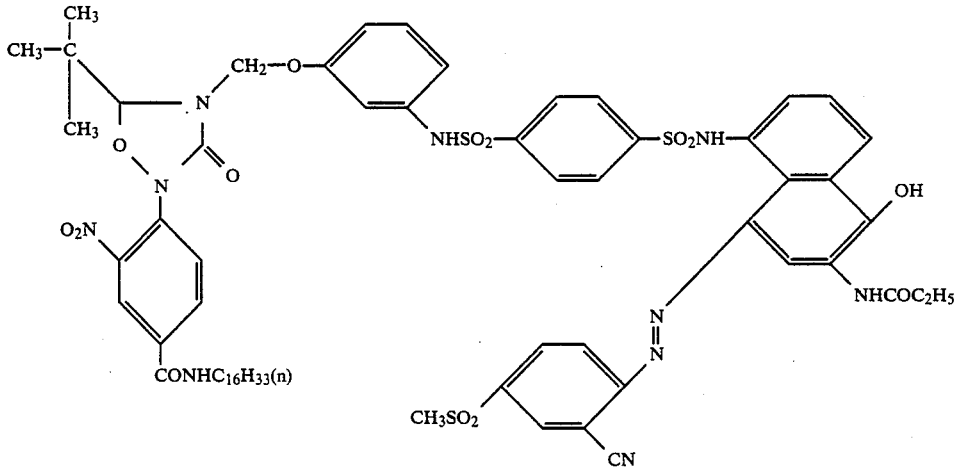

-continued
(32)
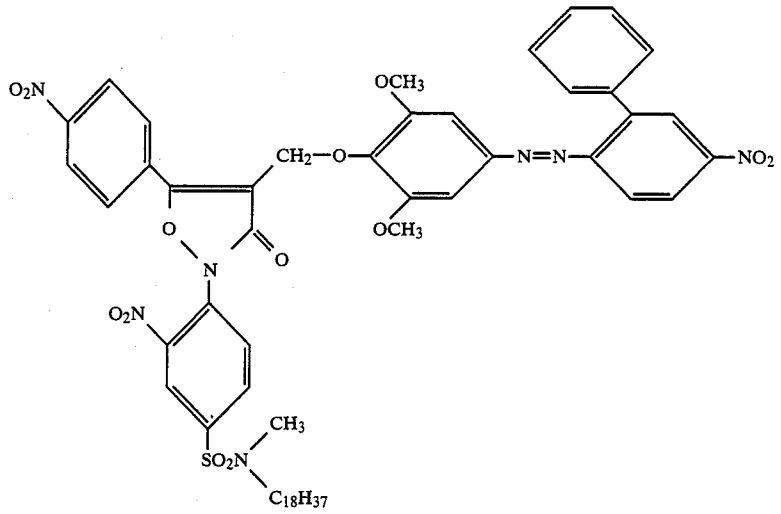
(33)
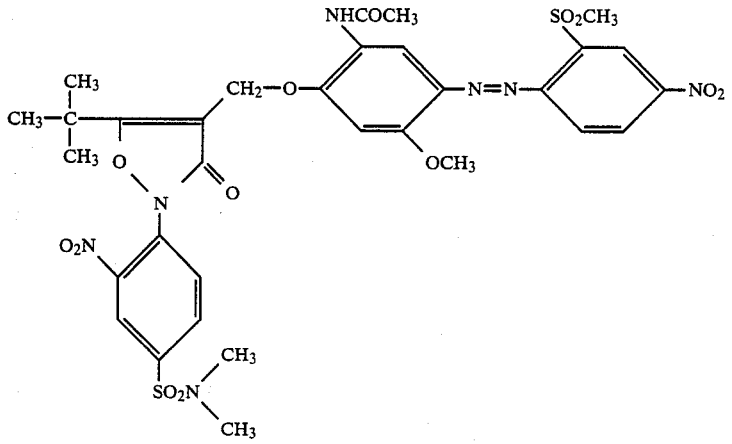
(34)
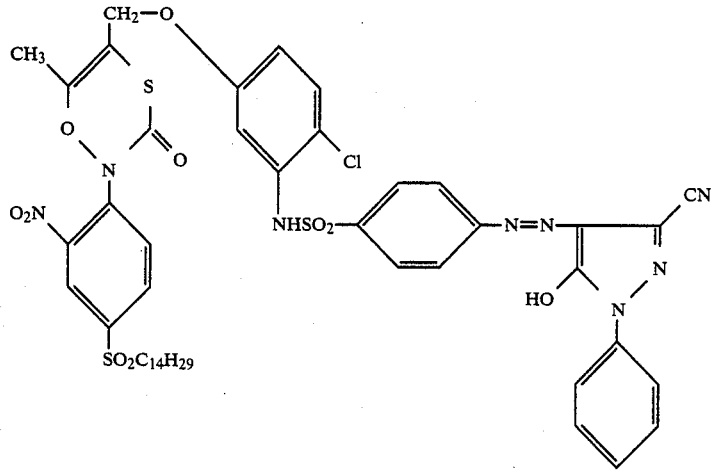

-continued
(35)
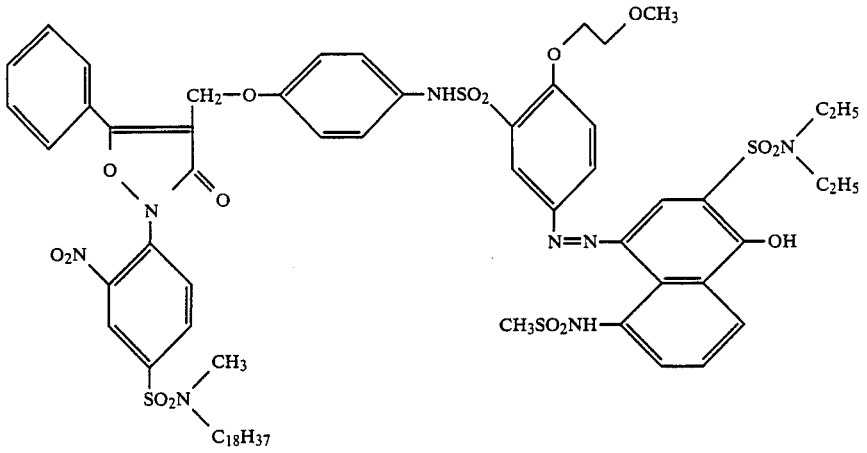
(36)
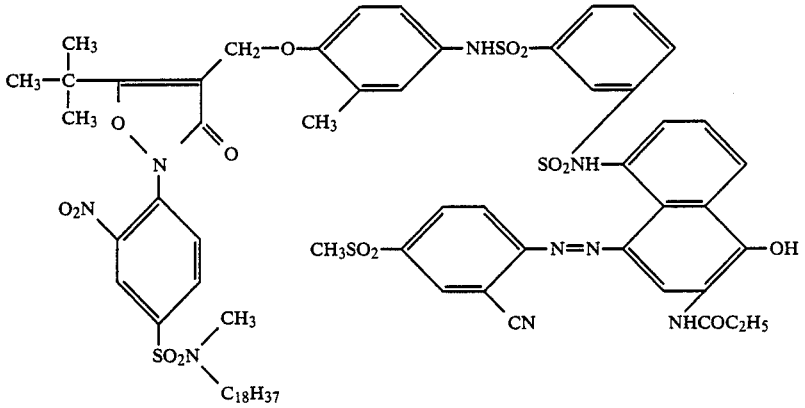
(37)
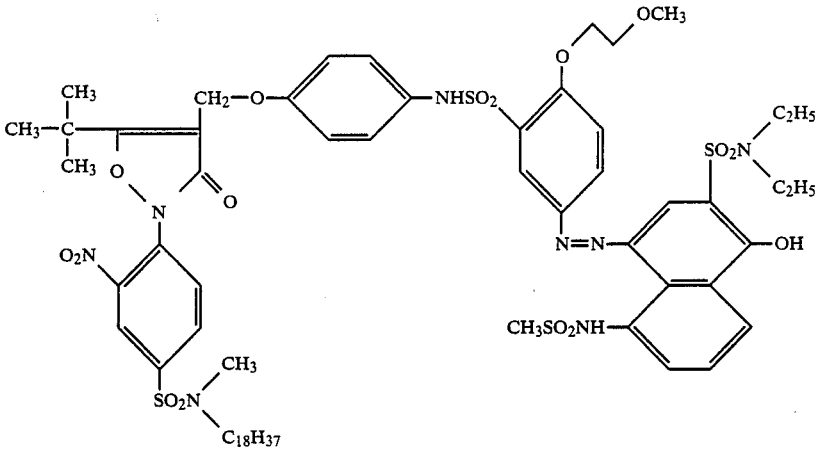

-continued
(38)
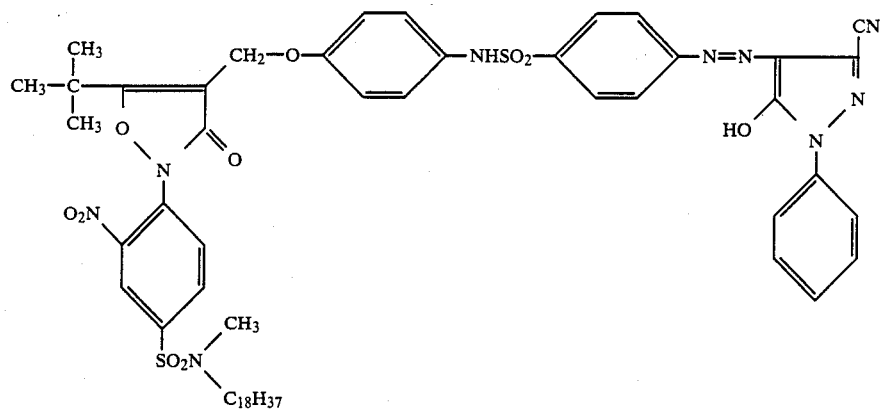
(39)
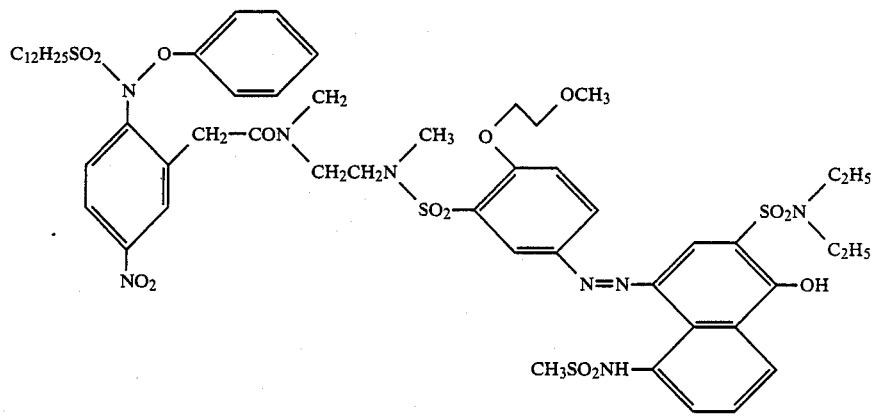
(40)
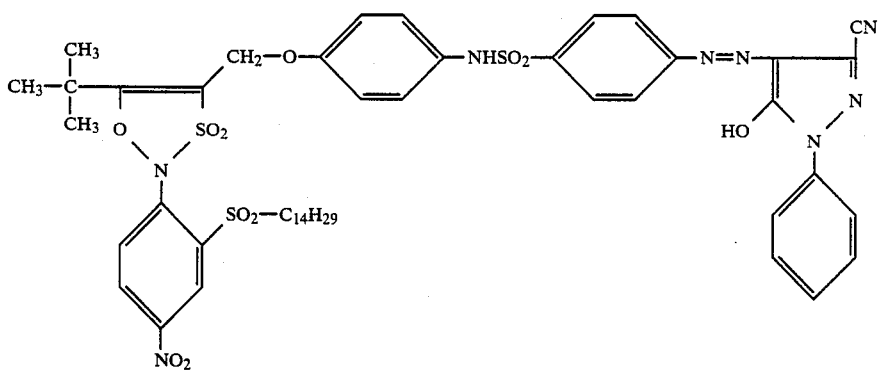
(41)
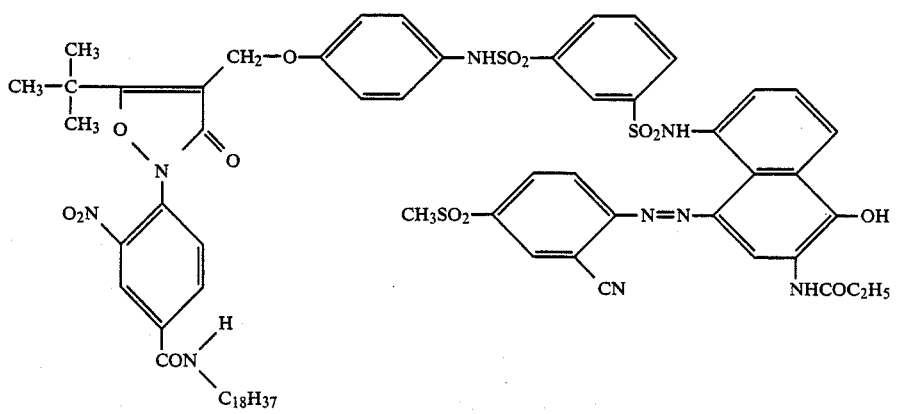

-continued
(42)
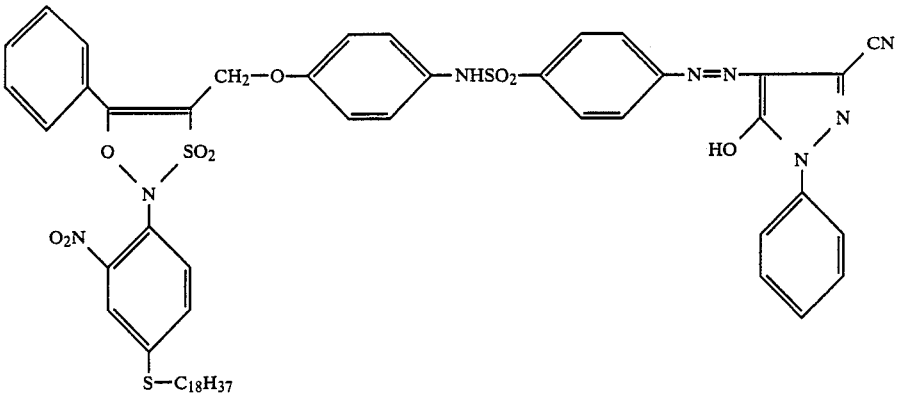
(43)
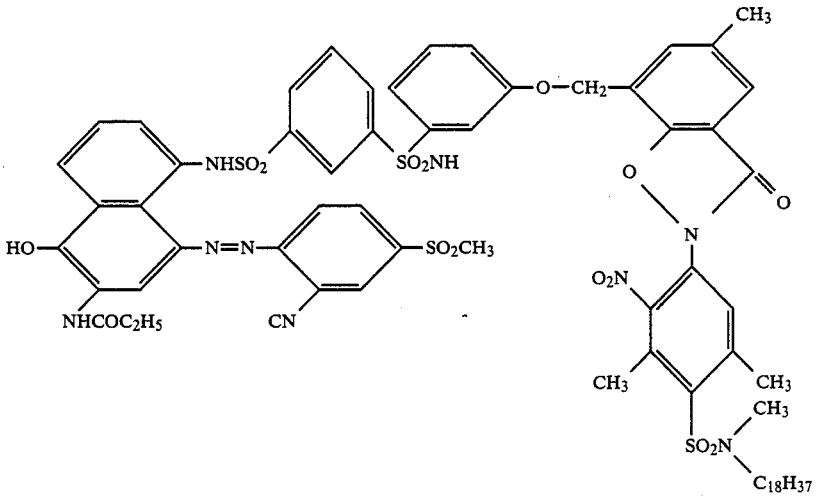
(44)
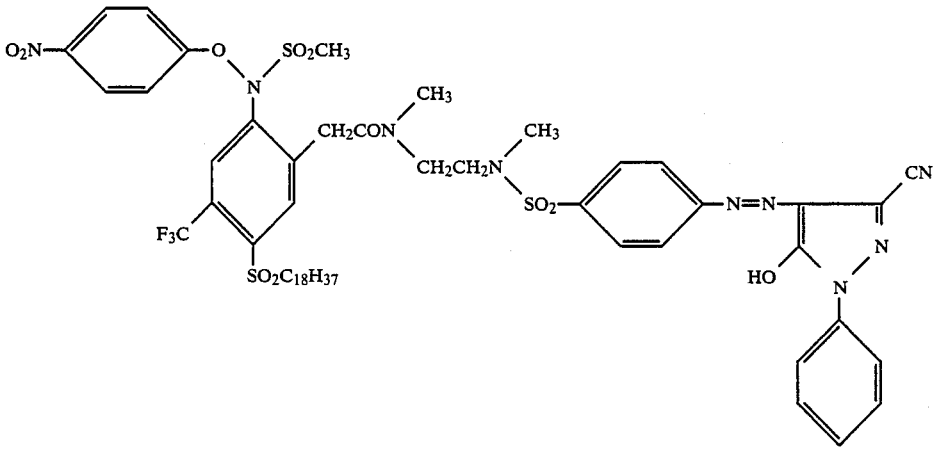

-continued
(45)
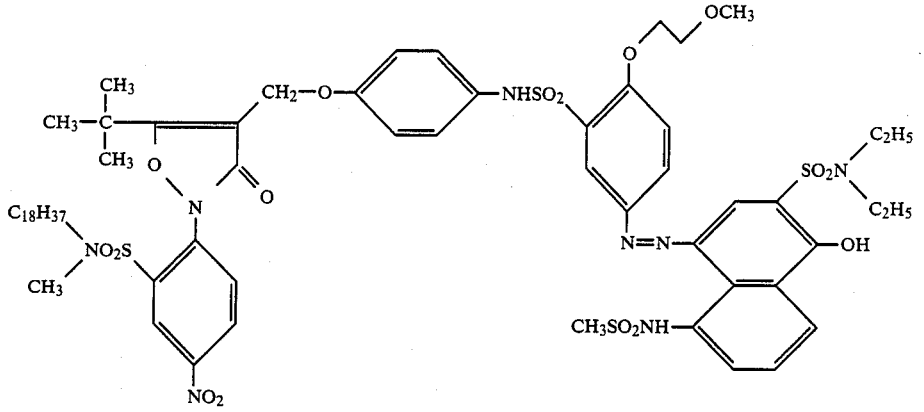
(46)
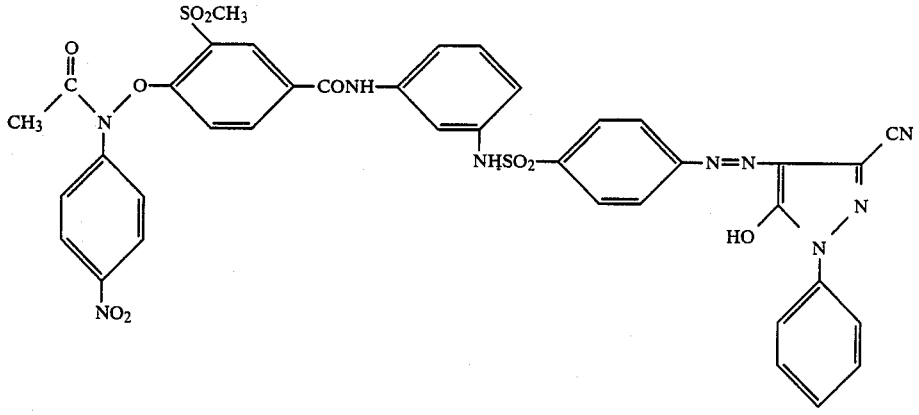
(47)
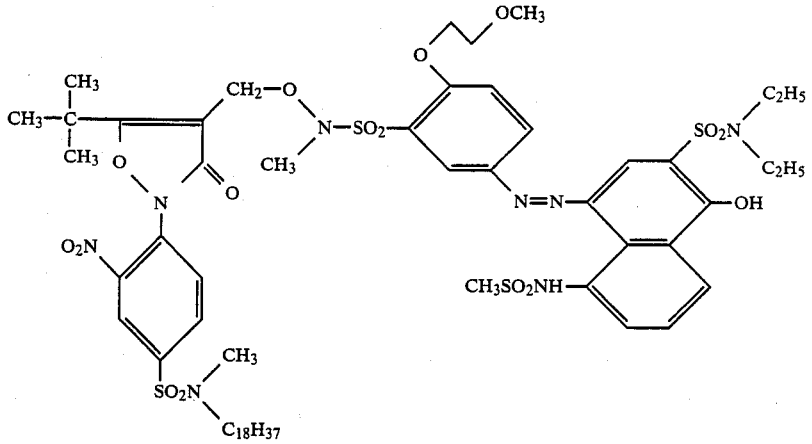
(48)
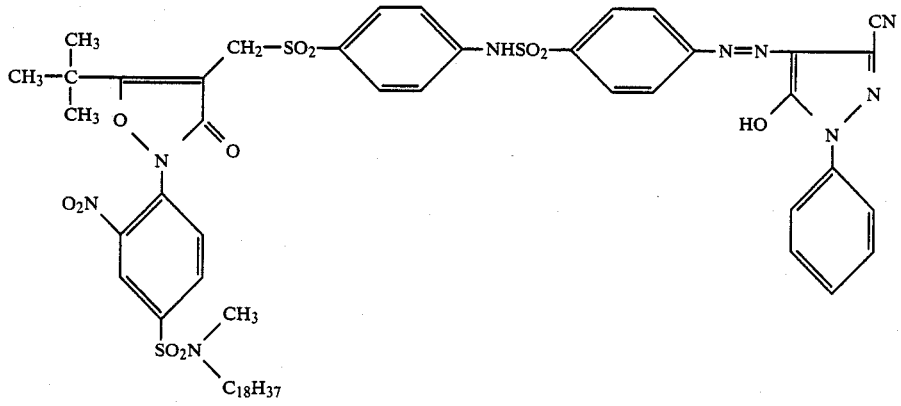

-continued
(49)
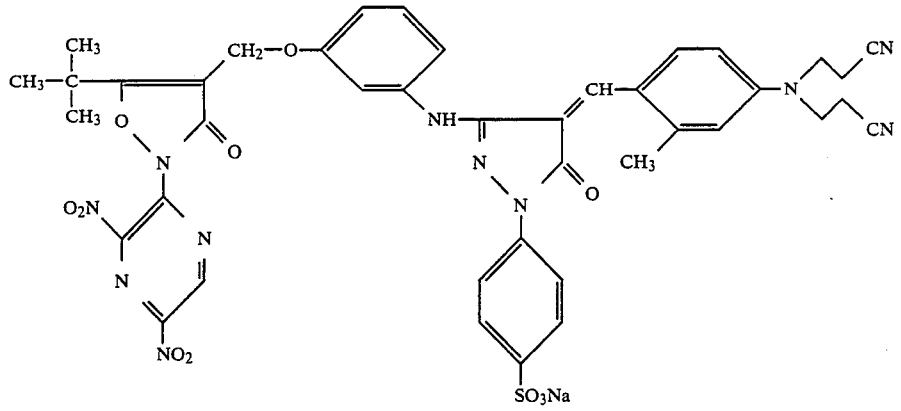
(50)
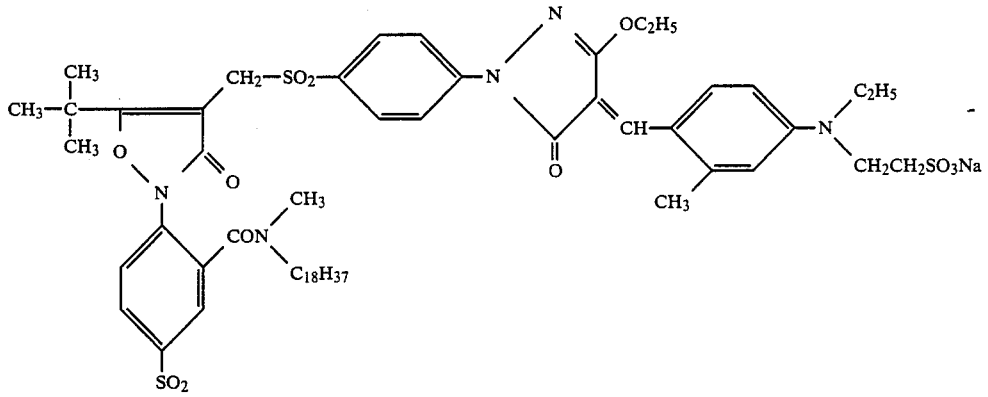
(51)
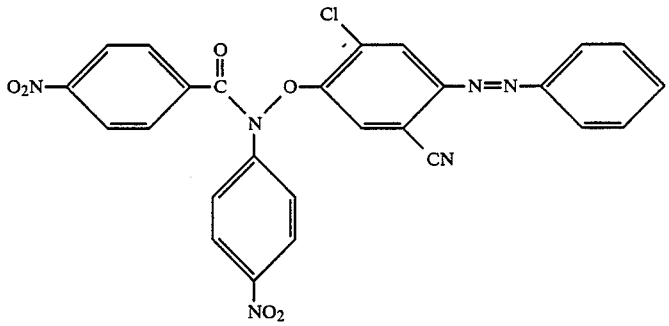
(52)
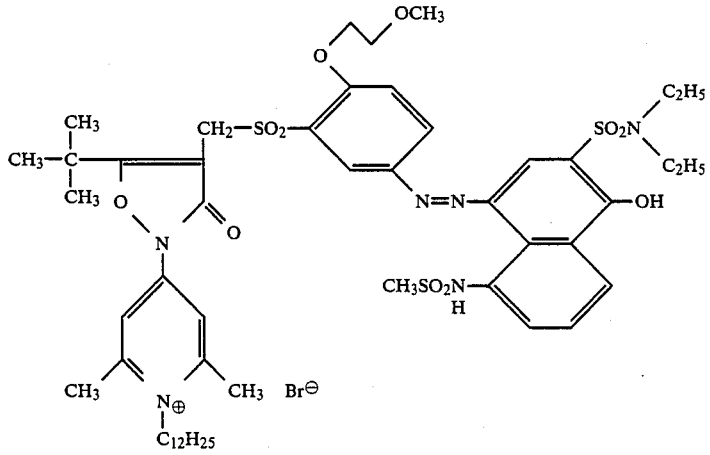

-continued
(53)
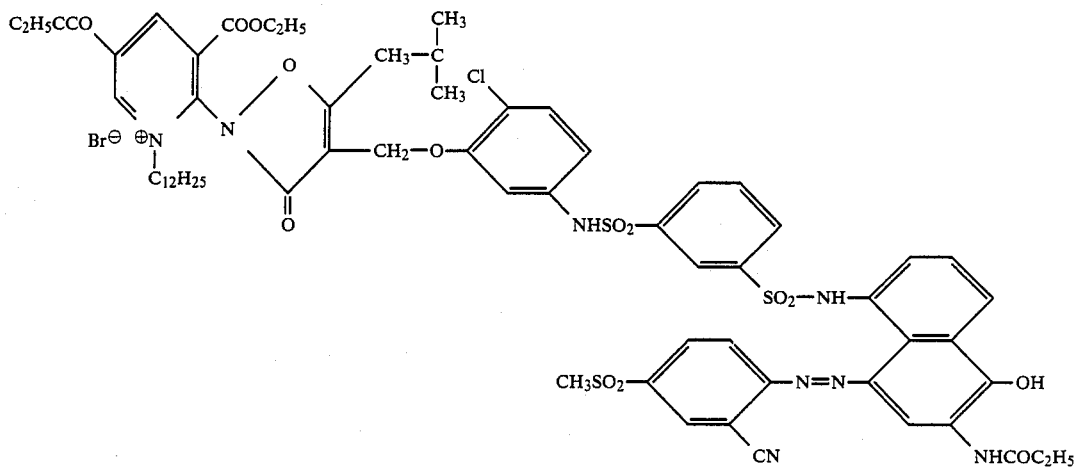
(54)
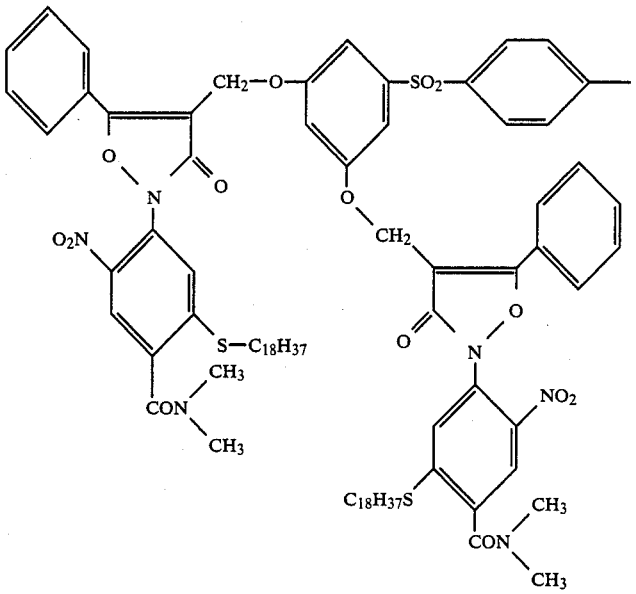
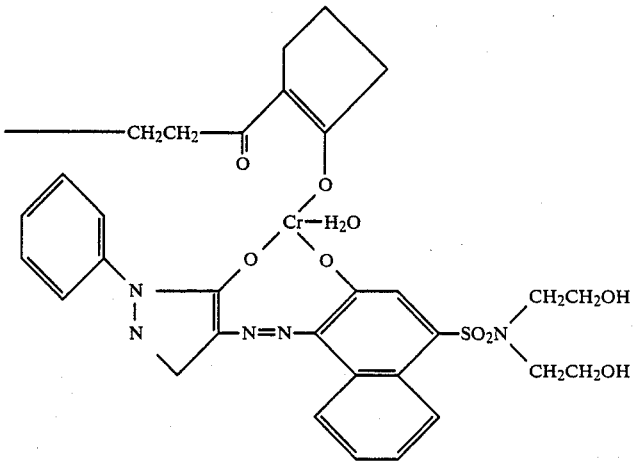

-continued
(55)
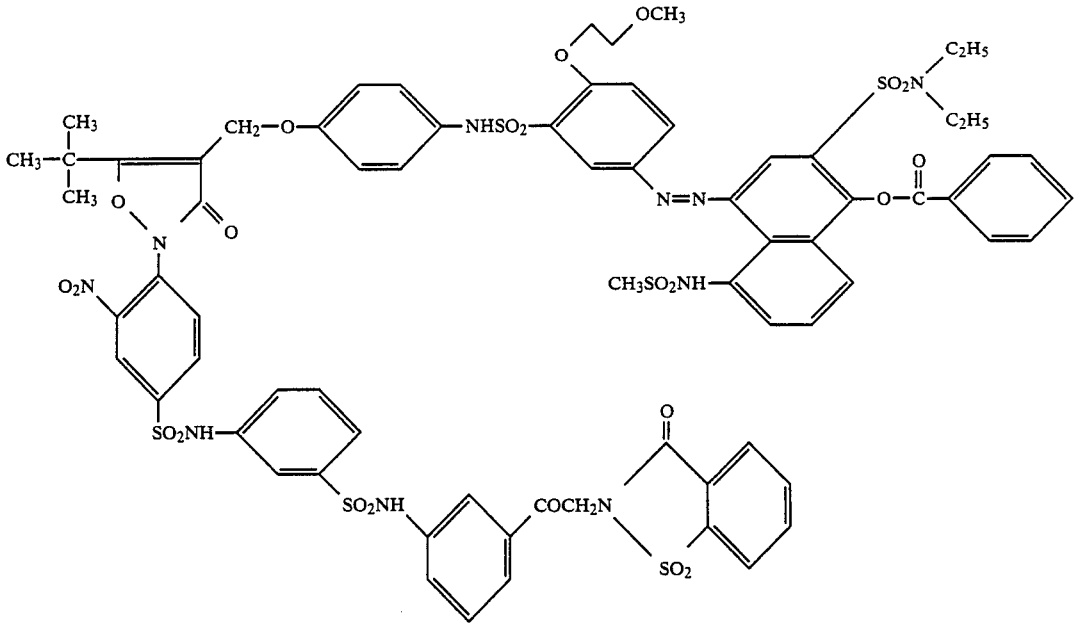
(56)
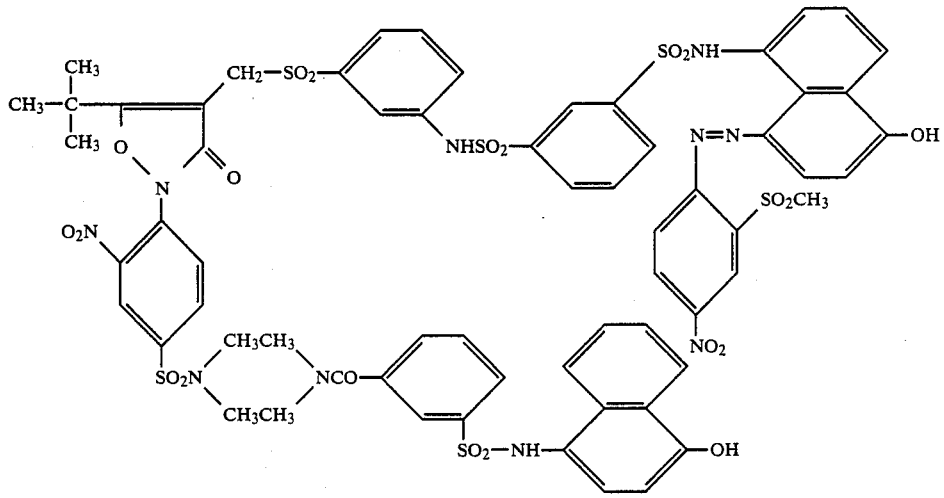
(57)
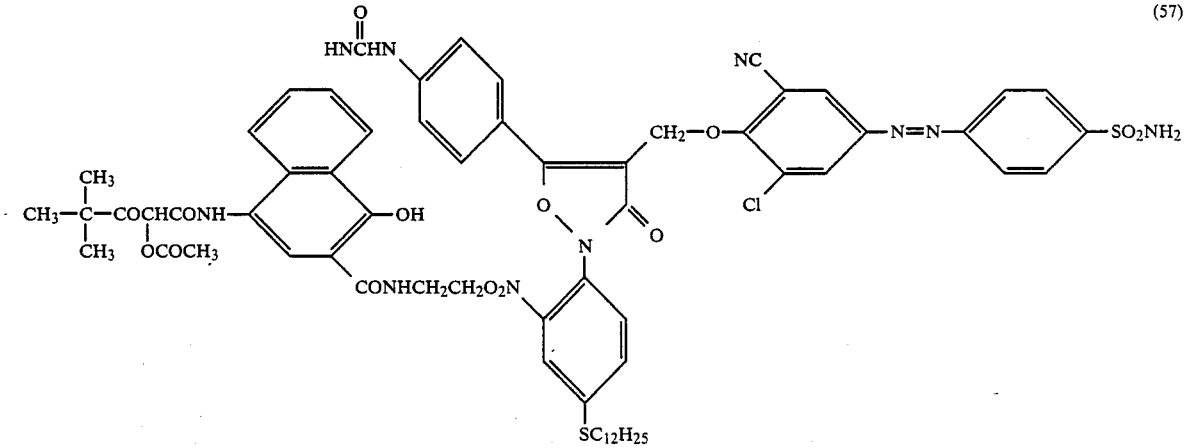

-continued
(58)
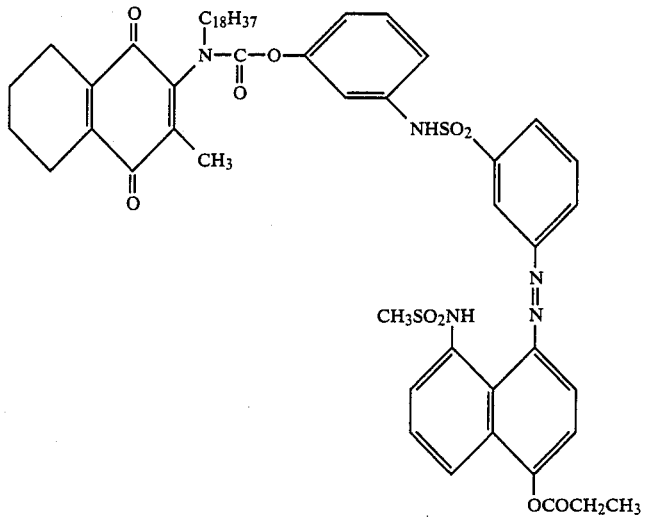
(59)
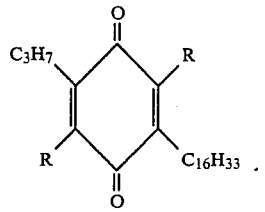
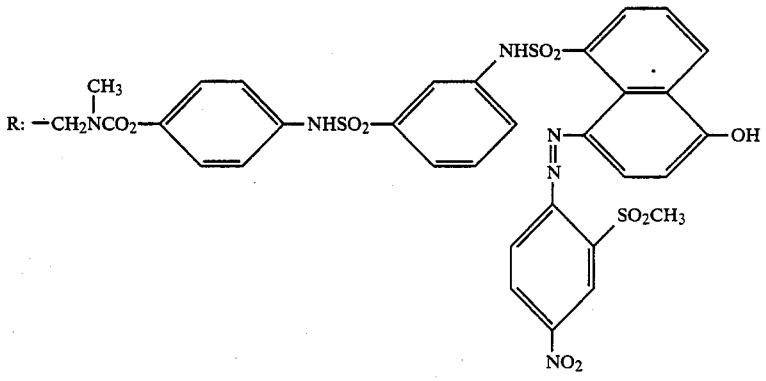
(60)
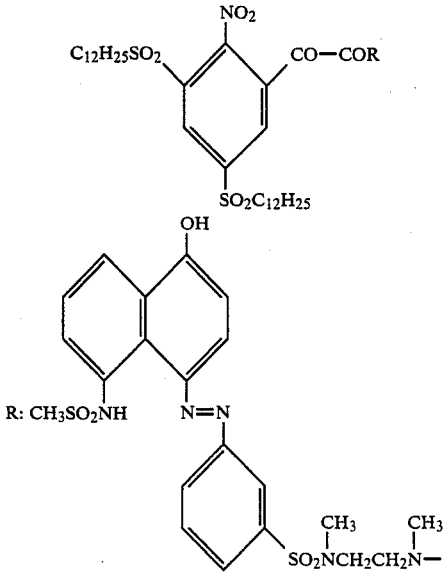

-continued
(61)
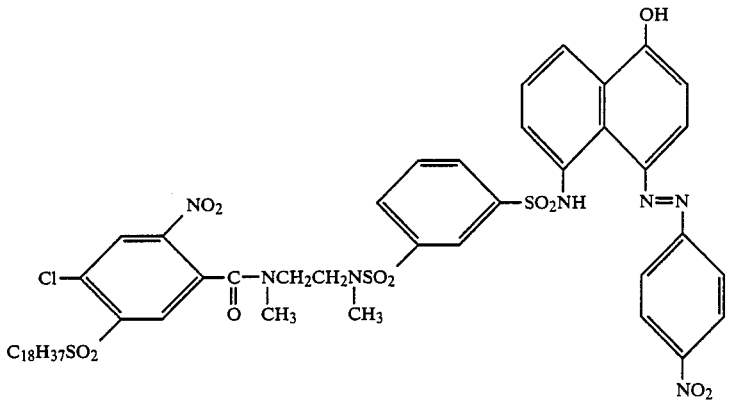
(62)
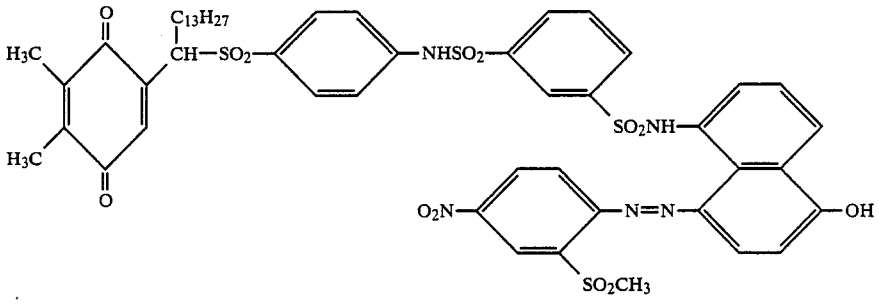
(63)
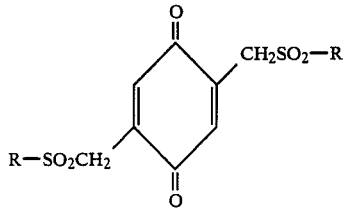
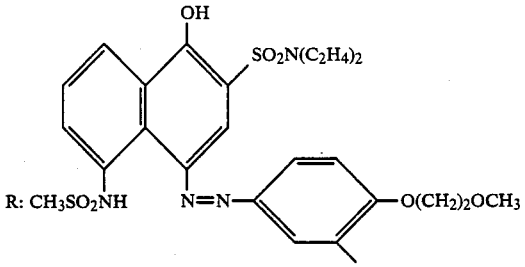
(64)
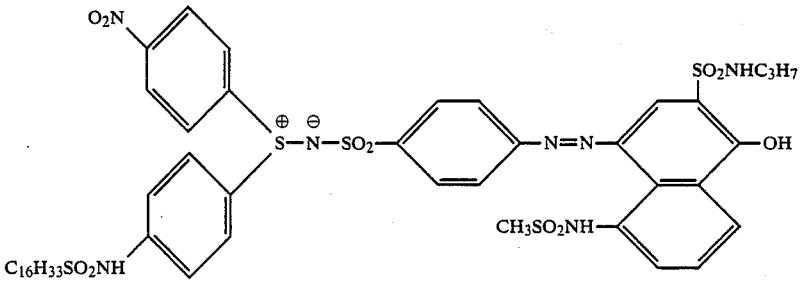

-continued
(65)
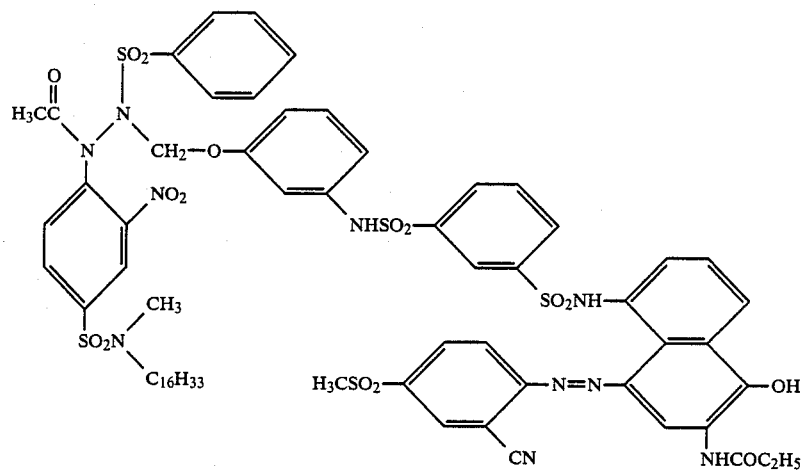
(66)
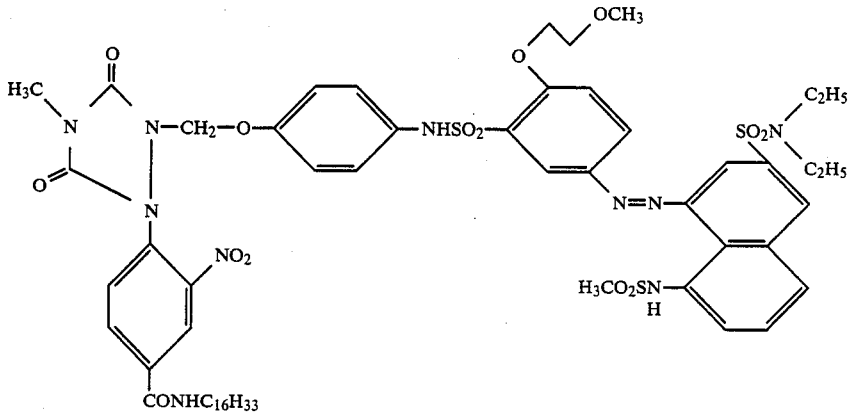
(67)
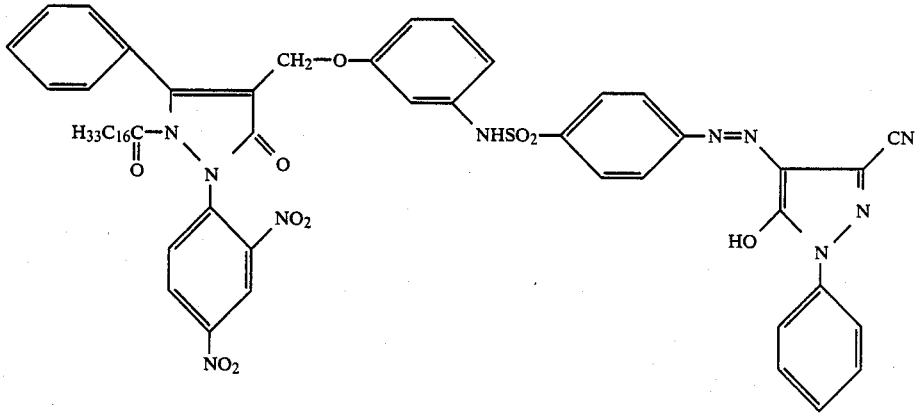

-continued
(68)
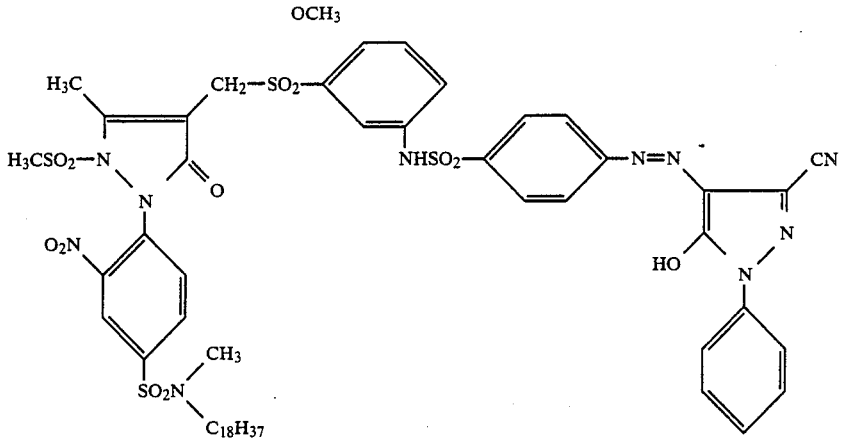
(69)
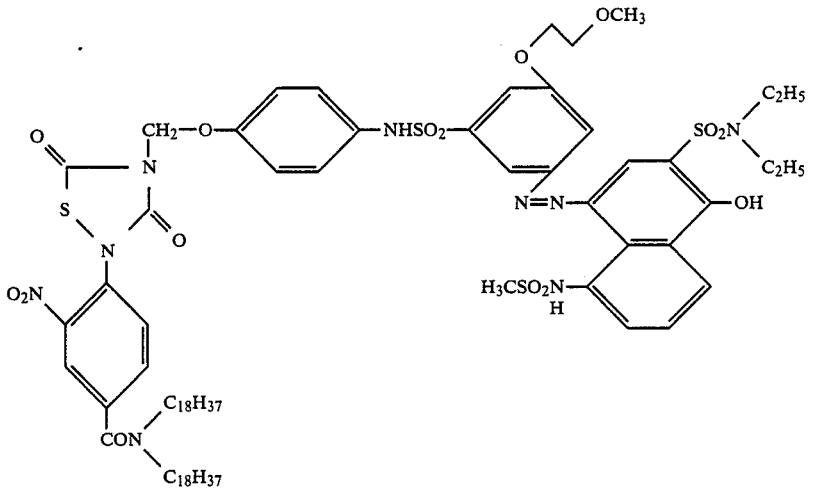
(70)
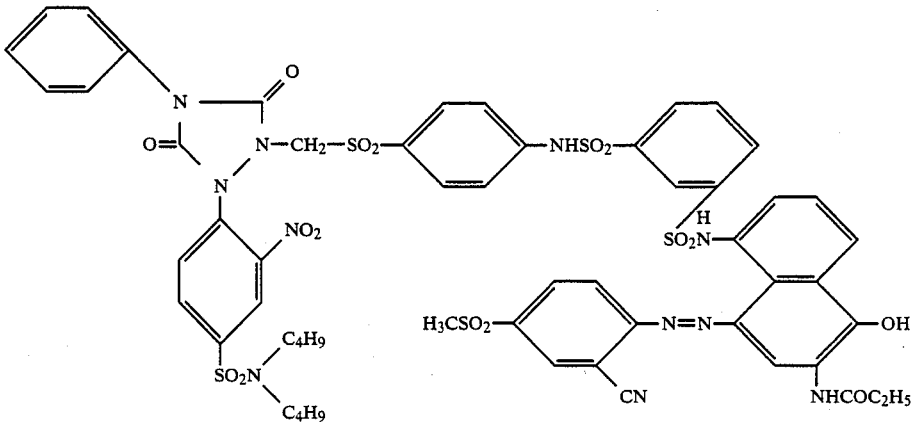

-continued
(71)
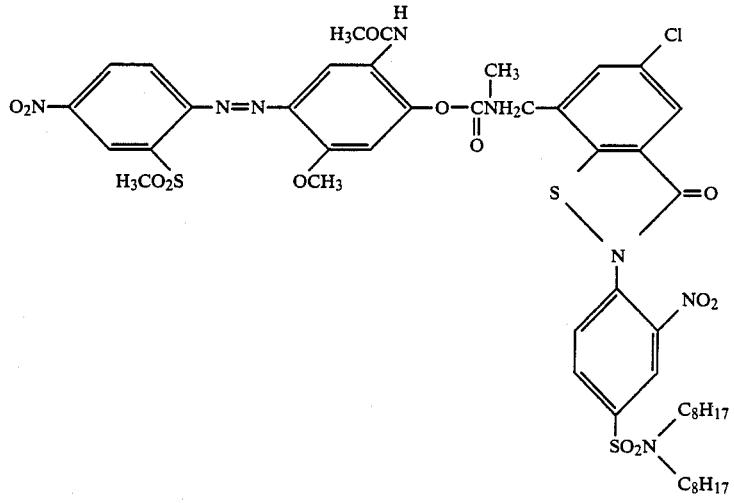
(72)
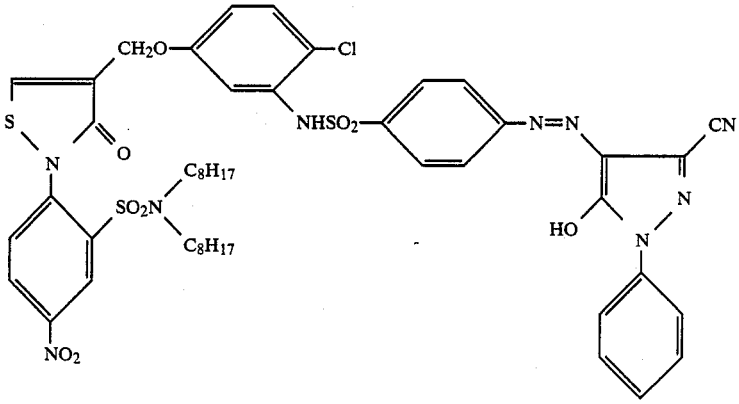
(73)
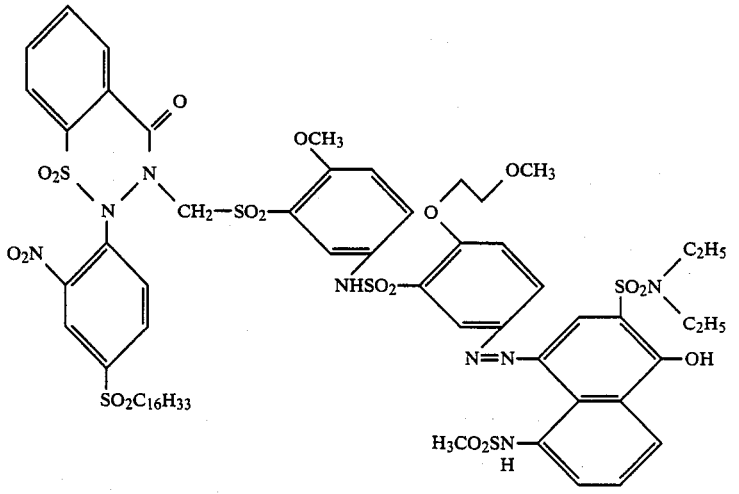

-continued (74)

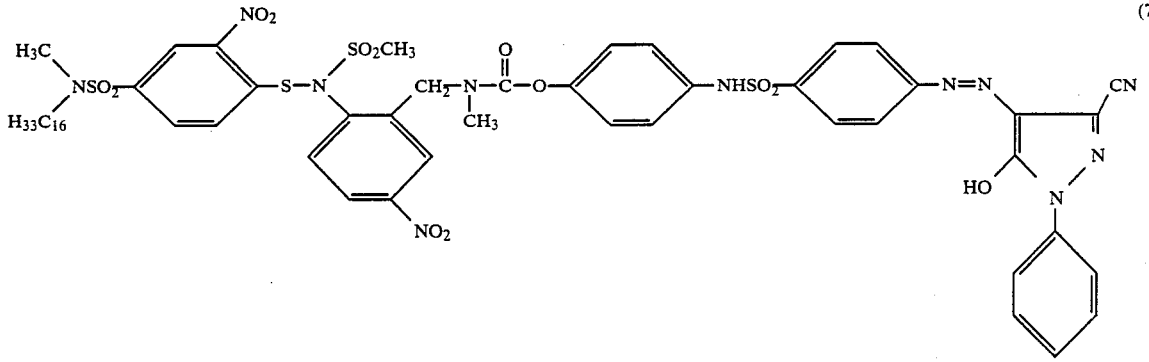

The amount of the dye-providing substance used herein may vary depending on the coefficient of light absorbance of the dye and generally ranges from 0.05 mmol to 5 mmol per square meter, preferably from 0.1 mmol to 3 mmol per square meter.

The dye-providing substances may be used alone or as a mixture of two or more. A mixture of dye-providing substances of different types may also be used.

In the practice of the present invention, a well-known development retarder or a precursor thereof may be used. Particularly when a positive dye-providing substance belonging to class (3) previously mentioned is used, a positive development retarder precursor is preferably added wherein Dye in general formula (C II), (C III), or (C IV) is converted to a development retarding group (AF). The positive development retarder precursors are described in Japanese Patent Application No. 61-287455. The addition of a development retarder or development retarder precursor further reduces fogging and improves image discriminating ability. The amount of development retarder or development retarder precursor added preferably ranges from about $1\times10^{-5}$ to about 10 mol, more preferably from about $1\times10^{-3}$ to about 1 mol per mol of silver.

When a positive dye-providing substance belonging to class (3) is combined with a positive development retarder precursor as mentioned above, the amount of development retarder precursor added preferably ranges from about $1\times10^{-3}$ to about $1\times10^{2}$ mol, more preferably from about $1\times10^{-2}$ to about 10 mol per mol of the dye-providing substance.

Examples of the development retarder or inhibitor (AF) include compounds having a mercapto group attached to a hetero ring, for example, substituted or unsubstituted mercaptoazoles such as 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylamino- ethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)phenyl]-5-mercaptotetrazole, 1-(4-nitrophenyl)-5-mercaptotetrazole, 5-(2-ethylhexanoylamino)-2-mercaptobenzimidazole, etc.;

substituted or unsubstituted mercaptoazaindenes such as 6-methyl-4-mercapto-1,3,3a,7-tetrazaindene, 6-methyl-2-benzyl-4-mercapto-1,3,3a,7-tetrazaindene, 6-phenyl-4-mercaptotetrazaindene, 4,6-dimethyl-2-mercapto-1,3,3a,7-tetrazaindene, etc.; and substituted or unsubstituted mercaptopyrimidines such as 2-mercaptopyrimidine, 2-mercapto-4-methyl-6-hydroxypyrimidine, 2-mercapto-4-propylpyrimidine, etc.

Also useful are heterocyclic compounds capable of forming imino silver, for example, substituted or unsubstituted benzotriazoles such as benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, 4,5,6,7-tetrachlorobenzotriazole, etc.; substituted or unsubstituted indazoles such as indazole, 5-nitroindazole, 3-nitroindazole, 3-chloro-5-nitroindazole, 3-cyanoindazole, 3-n-butylcarbamoylindazole, 5-nitro-3-methanesulfonylindazole, etc.; and substituted or unsubstituted benzimidazoles such as 5-nitrobenzimidazole, 4-nitrobenzimidazole, 5,6-dichlorobenzimidazole, 5-cyano-6-chlorobenzimidazole, 5-trifluoromethyl-6-chlorobenzimidazole, etc.

The development retarder may be such that while undergoing a redox reaction and subsequent reactions during a development process, it is released from the redox mother nucleus of formula (C II) as a compound having development retarding action and then converted into a compound having substantially no or little development inhibition. Examples are 1-(3-phenoxycarbonylphenyl)-5-mercaptotetrazole, 1-(4-phenoxycarbonylphenyl)-5-mercaptotetrazole, 1-(3-maleinimidephenyl)-5-mercaptotetrazole, 5-(phenoxycarbonyl)benzotriazole, 5-(p-cyanophenoxycarbonyl)benzotriazole, 2-phenoxycarbonylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonylethoxycarbonyl)-2-mercaptobenzothiazole, 1-[4-(2-chloroethoxycarbonyl)phenyl]-2-mercaptoimidazole, 2-[3-(thiophen-2-ylcarbonyl)propyl]thio-5-mercapto-1,3,4-thiadiazole, 5-cinnamoylaminobenzotriazole, 1-(3-vinylcarbonylphenyl)-5-mercaptotetrazole, 5-succinimidemethylbenzotriazole, 2-(4-succinimidephenyl)-5-mercapto-1,3,4-oxadiazole, 3-[4-(benzo-1,2-isothiazole-3-oxo-1,1-diox-2-yl)phenyl]-5-mercapto-4-methyl-1,2,4-triazole, 6-phenoxycarbonyl-2-mercaptobenzoxazole, etc.

These development retarders bond with Time, or R1, R2 or R3, or EAG of formula (C II) or (C III) via the site of development retarding ability, that is, the S atom of a mercapto group (-SH) or the N atom of an imino group.

Illustrative non-limiting examples of the development retarder precursor are given below.

AF-1

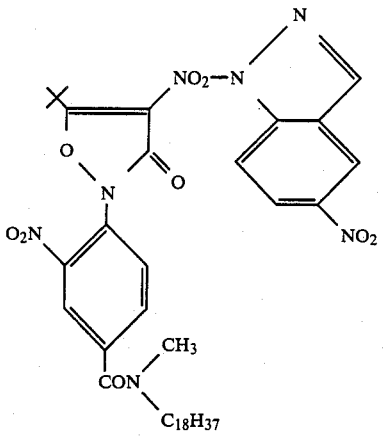

AF-2

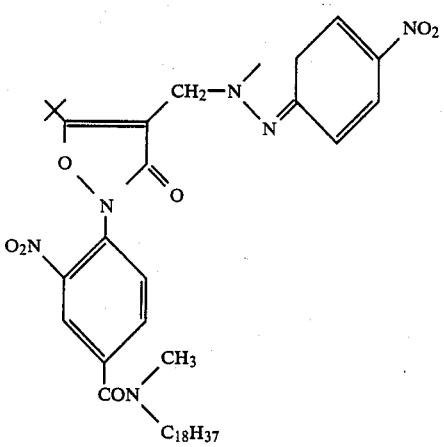

AF-3

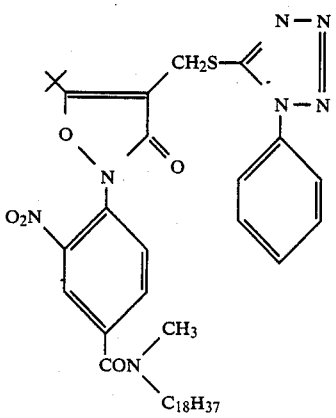

-continued

AF-4

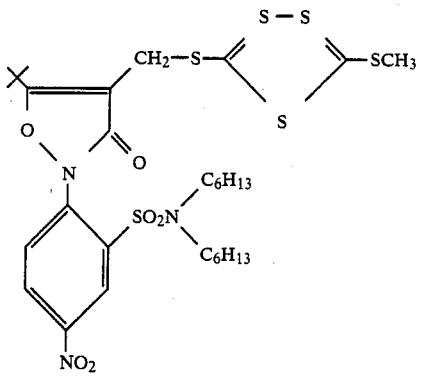

AF-5

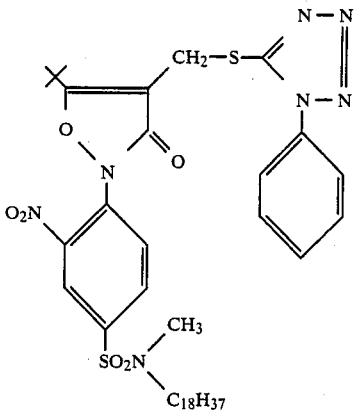

AF-6

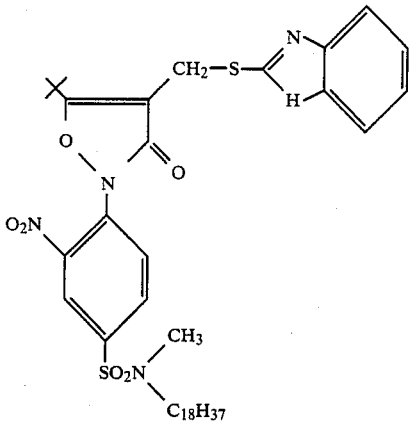

AF-7

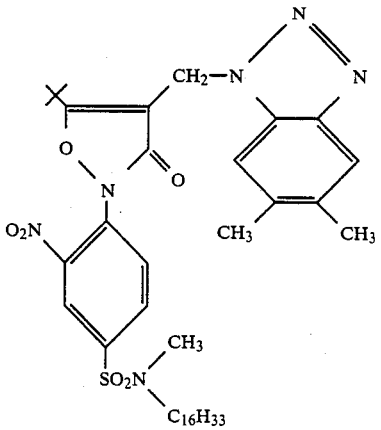

-continued

AF-8

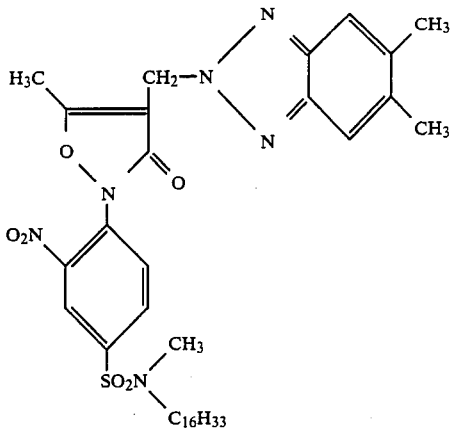

AF-9

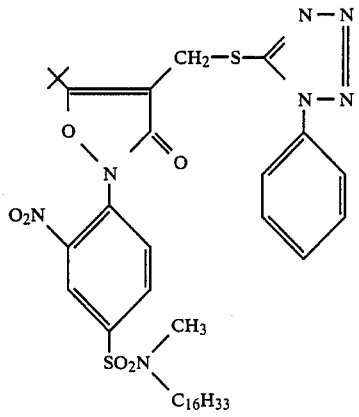

AF-10

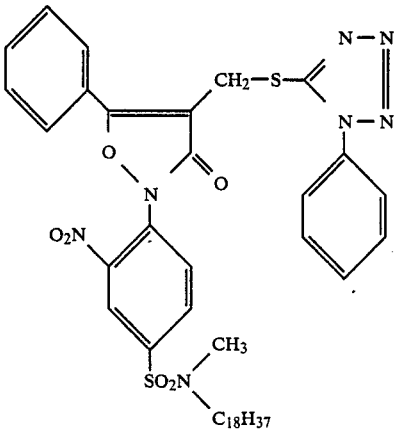

-continued

AF-11

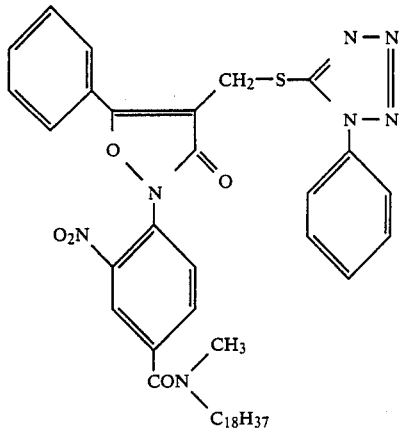

AF-12

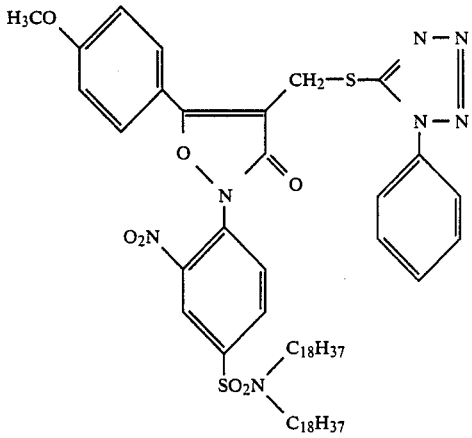

AF-13

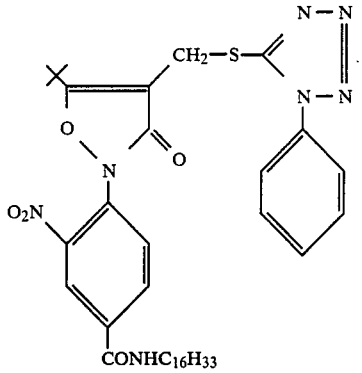

Hydrophobic additives including dye-providing substances and development retarder precursors as previously mentioned and image formation accelerators as will be later described may be introduced into a layer of a photosensitive element by any well-known method, for example, by the method described in U.S. Pat. No. 2,322,027. For such introducing purposes, a high-boiling organic solvent as described in Japanese Patent Application Kokai Nos. 59-83154, 59-178451, 59-178452, 59-178453, 59-178454, 59-178455 and 59-178457 may be used, optionally in combination with a low-boiling solvent having a boiling point of 50° to 160° C. The amount of the high-boiling organic solvent is preferably up to 10 grams, more preferably up to 5 grams per gram of the dye-providing substance used.

Further, it is possible to use a method for dispersion in polymers as described in Japanese Patent Publication No. 51-39853 and Japanese Patent Application Kokai No. 51-59943.

In case the substance is substantially insoluble in water, it may be finely divided into particles before being incorporated in the binder although the aforementioned methods may also be applicable. Moreover, various surfaceactive agents may be used when a hydrophobic substance like the dye-providing substance is dispersed in a hydrophilic colloid. For this purpose, the surfaceactive agents illustrated in Japanese Patent Application Kokai No. 59-157636, pages 37–38 may be used.

The reducing agent used herein may be any desired one as long as it has a function of reducing developable silver halide and another function that the resulting oxidant or the reductant that is left unreacted with the silver halide reacts with the dye-providing substance to form an imagewise distribution of the diffusible dye. Preferred are reducing agents for silver halide which are in accord with Kendal-Pelz equation described in James, "The Theory of the Photographic Process," 4th Ed. (1977), page 299.

Preferred examples of the reducing agent are:

3-pyrazolidones and precursors thereof, such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)4,4-dimethyl-3-pyrazolidone, 5-methyl-3-pyrazolidone, 1,5-diphenyl-3-pyrazolidone, 1-phenyl-4-methyl-4-stearoyloxymethyl-3-pyrazolidone, 1-phenyl-4-methyl-4-lauroyloxymethyl-3-pyrazolidone, 1-phenyl-4,4-bis(lauroyloxymethyl)-3-pyrazolidone, 1-phenyl-2-acetyl-3-pyrazolidone, 1-phenyl-3-acetoxypyrazolidone, etc.; and hydroquinones and precursors thereof such as hydroquinone, methylhydroquinone, 2,6-dimethylhydroquinone, t-butylhydroquinone, 2,5-di-t-butylhydroquinone, t-octylhydroquinone, 2,5-di-t-octylhydroquinone, pentadecylhydroquinone, sodium 5-pentadecylhydroquinone-2-sulfonate, p-benzoyloxyphenol, 2-methyl-4-benzoyloxyphenol, 2-t-butyl-4-(4-chlorobenzoyloxy)-phenol, etc.

Another useful example of the reducing agent for silver halide is a color developing agent. For example, U.S. Pat. No. 3,531,286 describes p-phenylene color developing agents as typified by N,N-diethyl-3-methyl-p-phenylenediamine. U.S. Pat. No. 3,761,270 describes aminophenols as a further useful example of the reducing agent. Particularly useful among the aminophenol reducing agents are 4-amino-2,6-dibromophenol, 4-amino-2,6-dibromophenol, 4-amino-2-methylphenol sulfate, 4-amino-3-methylphenol sulfate, 4-amino-2,6-dichlorophenol hydrochloride, etc. Further, Research Disclosure, Vol. 151, No. 15108 and U.S. Pat. No. 4,021,240 describe 2,6-dichloro-4-substituted sulfonamidephenols and 2,6-dibromo-4-substituted sulfonamidephenols, Japanese Patent Application Kokai No. 59-16740 describes p-(N,N-dialkylaminophenyl)sulfamines, which are all useful reducing agents in the present invention. In addition to the above-mentioned phenolic reducing agents, naphtholic reducing agents are also useful, for example, 4-aminonaphthol derivatives and 4-substituted sulfonamidenaphthol derivatives as described in Japanese Patent Application No. 60-100380. Other general color developing agents applicable herein are aminohydroxypyrazole derivatives as described in U.S. Pat. No. 2,895,825, aminopyrazoline derivatives as described in U.S. Pat. No. 2,892,714, and hydrazone derivatives as described in Research Disclosure, June 1980, pages 227–230 and 236–240 (RD-19412 and RD-19415). These color developing agents may be used alone or in admixture of two or more.

The reducing agent precursors used herein are those compounds which exert no reducing effect when stored before use of a heat-developable photosensitive material, but will acquire reducing ability under the influence of a suitable activator (for example, a base or nucleophilic agent) or heat. A particularly preferred reducing agent precursor used herein is a compound having a reactive functional group blocked with a blocking group, wherein the blocking group is cleaved by the action of an activator or heat so that the compound can now function as a reducing agent.

Examples of the reducing agent precursors used herein include 2- and 3-acyl derivatives and 2-aminoalkyl and hydroxyalkyl derivatives of 1-phenylpyrazolidone, metal (lead, cadmium, calcium, barium, etc.) salts of hydroquinone and catechol, halogenated acyl derivatives of hydroquinone, oxazine and bisoxazine derivatives of hydroquinone, lactone type reducing agent precursors, hydroquinone precursors having a quaternary ammonium group, and cyclohex-2-ene-1,4-dione compounds as well as a compound which releases a reducing agent through electron transfer reaction, a compound which releases a reducing agent through an intramolecular nucleophilic substitution reaction, a reducing agent precursor blocked with a phthalide group, and a reducing agent precursor blocked with an indomethyl group.

The reducing agent precursors are well-known compounds. Use may be made of the compounds described, for example, in U.S. Pat. Nos. 767,704, 3,241,967, 3,246,988, 3,295,978, 3,462,266, 3,586,506, 3,615,439, 3,650,749, 4,209,580, 4,330,617, 4,310,612, British Pat. Nos. 1,023,701, 1,231,830, 1,258,924 and 1,346,920, Japanese Patent Application Kokai Nos. 57-40245, 58-1139, 58-1140, 59-178458, 59-182449 and 59-182450.

In the practice of the present invention, the two functions of the reducting agent may be assigned to two separate reducing agents. This is effective particularly when a positive dye-providing substance belonging to class (3) mentioned above is used. More particularly, an electron donor which takes predominant charge in reaction with a dye-providing substance is used in combination with an auxiliary developing agent or electron transfer agent (ETA) which reduces a silver halide and undergoes crossoxidation with the electron donor.

The auxiliary developing or electron transfer agent may be selected from the above-mentioned reducing agents. In order that the auxiliary developing or electron transfer agent be more effective, the agent is desired to have greater mobility than an immobile reducing material.

The electron donor which is used in combination with the auxiliary developing or electron transfer agent may be selected from the above-mentioned reducing agents as long as it is substantially immobile in a layer of photosensitive material. Preferred examples are hydroquinones, aminophenols, aminonaphthols, 3-pyrazolidinones, saccharin and precursors thereof, picoliniums, and the compounds described as electron donors in Japanese Patent Application Kokai No. 53-110827.

The auxiliary developing or electron transfer agent which is used in combination with the electron donor may be any desired one as long as an oxidant thereof undergoes cross-oxidation with the electron donor. Preferred examples are 3-pyrazolidinones, aminophenols, phenylenediamines, reductones and reducing agent precursors as mentioned above, provided that all these compounds are diffusible.

The sharing of the two functions of reducing agent by a plurality of reducing agents may also be achieved by using a dye-providing substance having reducing nature itself (DRR compound) as mentioned above in combination with another reducing agent or auxiliary developing agent. The best effect is expected when a nucleating agent (or light) is used as a third reducing agent in addition to the above-mentioned two reducing agents combined and the silver halide used is of the internal latent image type. In this case, the cooperation of the internal latent image type silver halide, auxiliary developing agent, and nucleating agent (or light) allows for direct reversal development, and the cooperation of the auxiliary developing agent and DRR compound timely releases a diffusible dye, both enabling formation of a positive image having a high S/N ratio.

The auxiliary developing agent used in this embodiment may be the same as previously mentioned. The nucleating agent may be selected from those compounds described in Japanese Patent Application Kokai No. 61-107243.

The reducing agent or its precursor may be used in a certain concentration range. A concentration range of from 0.001 mol to 20 mol per mole of silver, especially from 0.01 mol to 10 mol per mole of silver is effective.

In the practice of the present invention, the reducing agent or its precursor may be introduced into a hydorphilic colloid layer by any well-known methods, for example, the method described in U.S. Pat. No. 2,322,027. In this case, an organic solvent having a high boiling point or an organic solvent having a low boiling point as described below may be used. For example, the reducing agent or its precursor is first dissolved in a high-boiling organic solvent, for example, a phthalic acid alkyl ester (such as dibutyl phthalate, dioctyl phthalate, etc.), a phosphoric acid ester (such as diphenyl phosphate, triphenyl phosphate, tricresyl phosphate, dioctylbutyl phosphate, etc.), a citric acid ester (such as tributyl acetylcitrate, etc.), a benzoic acid ester (such as octyl benzoate, etc.), an alkylamide (such as diethyl laurylamide, etc.), a fatty acid ester (such as dibutoxyethyl succinate, dioctyl azelate, etc.), and a trimesic acid ester (such as tributyl trimesate, etc.); or an organic solvent having a low boiling point of about 30° C. to 160° C., for example, a lower alkyl acetate (such as ethyl acetate, butyl acetate, etc.), ethyl propionate, sec-butyl alcohol, methyl isobutyl ketone, betaethoxyethyl acetate, methyl cellosolve acetate, cyclohexanone, etc. Mixtures of the above-described high boiling organic solvents and low boiling organic solvents may also be used. The solution of the reducing agent may then be dispersed in a hydrophilic colloid. Further, it is possible to use a method for dispersion in polymers as described in Japanese Patent Publication No. 51-39853 and Japanese Patent Application Kokai No. 51-59943. The reducing agent or its precursor may be either directly dispersed in an emulsion or dissolved in water or alcohol and then dispersed in gelatin or an emulsion.

The reducing agents and/or precursors thereof may be used alone or in admixture of two or more, and added to each of emulsion layers including blue-, green-, and redsensitive layers or all emulsion layers, or layers adjacent to the emulsion layers including an anti-halation layer, a primer layer, an intermediate layer, and a protective layer.

The silver halide used in the present invention includes silver chloride, silver bromide, silver chlorobromide, silver chloroiodide, and silver chloroiodobromide, but is not limited thereto.

More illustratively, use may be made of the silver halide emulsions described in U.S. Pat. No. 4,500,626, col. 50, Research Disclosure, June 1978, pages 19–10 (RD 17029), Japanese Patent Application Kokai No. 61-107240 and Japanese Patent Application Nos. 60-225176 and 60-228267.

The silver halide emulsions used in the practice of the present invention may be either of the surface latent image type wherein a latent image is predominantly formed on the grain surface or of the internal latent image type wherein a latent image is formed in the grain interior. A so-called core-shell emulsion may be used in which a core and a surface shell of a grain have different phases. Also employable is a direct reversal emulsion having an internal latent image type emulsion combined with a nucleating agent or secondary exposure. Details of the internal latent image type emulsion are described in Japanese Patent Application Kokai No. 61-107243.

The silver halide emulsions may be applied without post-ripening, but ordinarily after chemical sensitization. For chemical sensitization purpose, there may be used sulfur sensitization, reducing sensitization, noble metal sensitization and other processes which are well known in connection with the emulsions for photosensitive materials of the ordinary type, and combinations thereof. Such chemical sensitization may be carried out in the presence of a nitrogen-containing heterocyclic compound as disclosed in Japanese Patent Application Kokai Nos. 58-126526 and 58-215644.

The amount of the photosensitive silver halide coated preferably ranges from 1 mg to 10 g of silver per square meter.

In the practice of the present invention, an organic metal salt may be used as an oxidizing agent in combination with the photosensitive silver halide. It is necessary that the photosensitive silver halide and the organic metal salt be in contact with or close to each other. Preferred among these organic metal salts are organic silver salts.

Useful examples of the organic compounds which can be used to form the organic silver salt oxidizing agents are described in Japanese Patent Application Kokai No. 61-107240, and U.S. Pat. No. 4,500,626, columns 52–53. Also useful are silver salts of carboxylic acids having an alkynyl group such as silver phenylpropiolate as described in Japanese Patent Application No. 60-113235 and silver acetylene as described in Japanese Patent Application No. 60-90089. A mixture of two or more organic silver salts may be used.

The organic silver salt is used in an amount of from 0.01 to 10 mol, preferably from 0.01 to 1 mol per mole of photosensitive silver halide. The combined amount of the photosensitive silver halide and organic silver salt coated preferably ranges from 50 mg to 10 grams of silver per square meter.

The silver halides used in the practice of the present invention may be spectrally sensitized with methine dyes and other dyes. The dyes useful for spectral sensitization include cyanine dyes, merocyanine dyes, complex cyamine dyes, complex merocyanine dyes, holopolar cyanine dyes, hemicyanine dyes, styryl dyes, and hemioxonol dyes. Illustrative examples are the sensitizing dyes disclosed in Japanese Patent Application Kokai Nos. 59-180550 and 60-140335 and Research Disclosure, June 1978, pages 12–13 (RD 17029); and the sensitizing dyes of heat-decoloring nature disclosed in Japanese Patent Application Kokai No. 60-111239 and Japanese Patent Application No. 60-172967. These sensitizing dyes may be used individually or as a combination thereof. A combination of sensitizing dyes is frequently used for supersensitization.

In addition to the sensitizing dye, the emulsion may contain a dye which itself has no spectral sensitization function or a material which does not substantially absorb visible light, but is capable of supersensitization. Such supersensitizing compounds are disclosed in the following U.S. Patents:

| | | |
|---|---|---|
| 2,933,390 | 3,615,613 | 3,615,641 |
| 3,617,295 | 3,635,721 | 3,743,510. |

These sensitizing dyes may be added to the emulsion during, before or after chemical ripening, or before or after nucleation of silver halide grains according to the teachings of U.S. Pat. Nos. 4,183,756 and 4,225, 666. The amount of the sensitizing dye is generally from $10^{-8}$ to $10^{-2}$ mol per mol of the silver halide.

Further, in the present invention, it is possible to use a compound which activates development simultaneously with stabilizing an image. Particularly preferred compounds used herein are those described in U.S. Pat. No. 4,500,626, columns 51–52.

A variety of anti-fogging agents or photographic stabilizers may be used in the practice of the present invention. Preferred anti-fogging agents are azoles and azaindenes as disclosed in Research Disclosure, December 1978, pages 24–25, nitrogen-containing carboxylic acids and phosphoric acids as described in Japanese Patent Application Kokai No. 59-168442, mercapto compounds and metals salts thereof as described in Japanese Patent Application Kokai No. 59-111636, and acetylene compounds as described in Japanese Patent Application No. 60-228267.

The photosensitive material used in the practice of the present invention may contain a toning agent if desired. Useful toning agents are those described in Japanese Patent Application Kokai No. 61-147244, page 24.

In order to provide a wide range of color within the chromaticity diagram using the three primary colors, yellow, magenta and cyan, the photosensitive material used in the present invention should include at least three silver halide emulsion layers having sensitivity in different spectra. Combinations of three layers, typically blue-, green-, and red-sensitive layers, and green-, red-, and infraredsensitive layers are contemplated herein. One photosensitive emulsion layer having sensitivity in a certain spectrum may be divided into two or more sublayers, if desired.

Between photosensitive layers having different color sensitivities is preferably inserted an intermediate layer which contains a color-mixing inhibitor. It is also preferable to add a color-fogging inhibitor to a photosensitive layer. Examples of the color-mixing or color-fogging inhibitor include hydroquinones, aminophenols, amines, gallic acid derivatives, catechols, ascorbic acid derivatives, colorless couplers, and sulfonamidephenols.

The photographic material according to the present invention is comprised of a photosensitive element which forms or releases a dye through heat development and a dye-fixing element which fixes the dye. Particularly, systems of forming an image through diffusion transfer of a dye need the photosensitive and dye-fixing elements as requisite elements. They are generally classified into two typical forms, one form having photosensitive and dye-fixing elements separately applied on two separate supports and another form having both photosensitive and dye-fixing elements applied on a common support. With respect to the relation of the photosensitive element and the dye-fixing element to one another, to the support, and to a white reflective layer, reference may be made to the descriptions of Japanese Patent Application Kokai No. 61-147244, pages 15–16 and U.S. Pat. No. 4,500,626, col. 57.

The dye-fixing element preferably used in the present invention has at least one layer containing a mordant and a binder. The mordant may be selected from those known in the photographic art, for example, the compounds described in Japanese Patent Application Kokai No. 61-88256.

The dye-fixing element may optionally be provided with any auxiliary layers, for example, a protective layer, peeling lyaer, and anti-curling layer, in addition to the above-mentioned layers. Provision of a protective layer is effective. One or more of these layers may contain a hydrophilic thermal solvent, plasticizer, anti-discoloration agent, UV absorber, sliding agent, matte agent, antioxidant, dispersed vinyl compound for increasing dimensional stability, surface-active agent, brightener, etc. Particularly in a system of carrying out heat development and dye transfer at the same time in the presence of a small amount of water, a base and/or base precursor is preferably contained in a dye-fixing material in order to increase the shelf stability of the photosensitive material. Illustrative examples of these additives are described in Japanese Patent Application Kokai No. 61-88256, pages 24–32.

An image formation promotor may also be used in the photosensitive material and/or dye-fixing material in the practice of the present invention. The image formation promotors have the functions of promoting such reaction as redox reaction of a silver salt-oxidizing agent with a reducing agent, formation of a dye from a dye-providing substance, decomposition of a dye or release of a mobile dye, and promoting transfer of a dye from a photosensitive material layer to a dye-fixing layer. From their physicalchemistry, they may be classified into bases, base precursors, nucleophilic compounds, high-boiling organic solvents (oils), thermal solvents, surface-active agents, and compounds capable of interacting with silver or silver ion. It should be noted that these compounds generally have multiple functions and thus possess some of the above-mentioned promoting effects combined. For further detail, reference is to be made to Japanese Patent Application Kokai No. 61-88256, pages 17–20, which is incorporated herein by reference.

The base is used herein in its usual meaning well known in the art. The base precursor is also used herein in its usual meaning as designating a compound which itself is not a base, but releases a base through catalytic, thermal, or electrolytic decomposition or reaction with another compound. The concept of base and base precursor is described in connection with the transfer aid and image formation promotor and will also be understood from the following description.

A number of other base-producing methods are known and any of the compounds used in these methods are useful as the base precursor. For example, copending U.S. patent application Ser. No. 890,442, filed July 30, 1986 and assigned to the same assignee as the present invention discloses a method for producing a base by mixing a difficultly soluble metal compound with a compound (complexing compound) capable of forming a complex with the metal ion of the metal compound, and Japanese Patent Application Kokai No. 61-232451 discloses electrolytic base generation.

The former method is particularly effective. Examples of the difficultly soluble metal compounds include carbonates, hydroxides, and oxides of zinc, aluminum, calcium, and barium. The complexing compounds are detailed in, for exaple, A. E. Martell and R. M. Smith, "Critical Stability Constants", Vol. 4 and 5, Plenum Press. Some illustrative examples of the complexing compounds include salts of aminocarboxylic acids, imidinoacetic acids, pyridylcarboxylic acids, aminophosphoric acids, carboxylic acids (including mono-, di-, tri-, and tetracarboxylic acids with or without such a substituent as phosphono, hydroxy, oxo, ester, amide, alkoxy, mercapto, alkylthio, phosphino, etc.), hydroxamic acids, polyacrylic acids, and polyphosphoric acids with alkali metals, guanidines, amidines, and quaternary ammonium. It is advantageous to separately add the difficultly soluble metal compound and the complexing compound to the photosensitive material and the dye-fixing material, respectively, or vice verse.

In the practice of the present invention, a variety of development inhibitors may be used in the photosensitive material and/or dye-fixing material for the purpose of obtaining a consistent image irrespective of variations in treating temperature and time during heat development. By the development inhibitor is meant those compounds capable of, immediately after development has proceeded to an optimum extent, neutralizing or reacting with a base to reduce its concentration in the film to inhibit development, or those compounds capable of, immediately after optimum development, interacting with silver or silver salt to retard development. Illustrative examples are acid precursors capable of releasing acid upon heating, electrophilic compounds capable of substitution reaction with a coexisting base upon heating, nitrogen-containing heterocyclic compounds, mercapto compounds and their precursors, and the like. Specific examples are disclosed in Japanese Patent Application Kokai Nos. 60-108837, 60-192939, 60-230133, and 60-230134.

Also useful are those compounds which release mercapto compounds upon heating, for example, those described in the following Japanese Patent Application Kokai Nos.

| | | |
|---|---|---|
| 61-053632 | 61-067851 | 61-124941 |

-continued

| | | |
|---|---|---|
| 61-147244 | 61-182039 | 61-184539 |
| 61-185743 | 61-185744 | 61-188540 |

The binders employed in the photosensitive material and/or dye-fixing material in the practice of the present invention may be hydrophilic. The typical hydrophilic binder is a transparent or translucent hydrophilic binder, examples of which include natural substances, for example, proteins such as gelatin, gelatin derivatives and cellulose derivatives and polysaccharides such as starch, dextran, pluran, gum arabic, etc.; and synthetic polymers, for example, water-soluble polyvinyl compounds such as polyvinyl alcohol, polyvinyl pyrrolidone, acrylamide polymer, etc. Another example of the synthetic polymer compound is a dispersed vinyl compound in a latex form which is used for the purpose of increasing the dimensional stability of a photographic material. These binders may be used alone or in admixture. The binders may be coated in amounts of up to 20 grams per square meter, preferably up to 10 grams per square meter, and most preferably up to 7 grams per square meter.

The high-boiling organic solvent may be dispersed in the binder together with hydrophobic compounds, for example, a dye-providing substance such that the volume of the solvent is less than about 1 cc, preferably less than about 0.5 cc, and most preferably less than about 0.3 cc per gram of the binder.

Any of the layers of the photosensitive material and the dye-fixing material according to the present invention, including photographic emulsion, dye-fixing and other layers, may contain inorganic or organic hardeners. Illustrative examples of the hardeners are those set forth in Japanese Patent Application Kokai No. 59-157636, page 38, Japanese Patent Application No. 60-231093, pages 5–8, and Japanese Patent Application Kokai No. 61-147244. They may be used alone or in combination.

The support suitable for use in the photosensitive material and/or dye-fixing material according to the present invention must withstand the processing temperature. Exemplary of ordinary supports there may be given not only glass, paper, polymer film, metal and analogues, but also those described as supports in Japanese Patent Application Kokai Nos. 61-110135, 61-113058, 61-158325, and 61-176931.

The photosensitive material and/or dye-fixing material according to the present invention may have an electroconductive heating element layer serving as heating means for heat development or diffusion transfer of dye. Such a transparent or opaque heating element may be provided in the form of a resistance heating element using a conventional well-known technique. The resistance heating element may be prepared by utilizing a thin film of a semiconductive inorganic material or an organic thin film of conductive fine particles dispersed in a binder. The materials which can be used in these methods are described in Japanese Patent Application Kokai Nos. 61-29835, 61-145544 and 61-209446.

In the practice of the present invention, the heat-developable photosensitive, protective, intermediate, undercoat, backcoat, dye-fixing, and other layers may be applied by any conventional coating methods, typically, the method described in U.S. Pat. No. 4,500,626, columns 55–56.

The light source for imagewise exposure to record an image in the heat-developable photosensitive may be any radiation including visible light. In general, light sources used in ordinary color printing may be used, for example, tungsten lamps, mercury lamps, halide lamps such as iodide lamps, xenon lamps, laser light sources, CRT light sources, and light-emitting diodes (LED) as set forth in Japanese Patent Application Kikai No. 61-147244 and U.S. Pat. No. 4,500,626, col. 56.

According to the image forming method of the present invention, a heat-developable photosensitive material comprising at least (a) a photosensitive silver halide, (b) a reducing agent or a precursor thereof, (c) a dye-providing substance which forms or releases a diffusible dye in proportion or counter-proportion to the reduction of the silver halide into silver, and (d) a binder on a support is imagewise exposed. During or after the imagewise exposure of the photosensitive material, the photosensitive material is maintained under such conditions for a predetermined time that the reaction between the silver halide and the reducing agent preferentially takes place rather than the reaction of forming or releasing a diffusible dye. The exposed material is then heat developed in the presence of a base and/or a base precursor to imagewise produce a diffusible dye. There is obtained a dye image with less fog and high image discriminability.

EXAMPLES

In order that those skilled in the art may better understand how the present invention may be practiced, the following examples are given by way of illustration and not by way of limitation.

EXAMPLE 1

Preparation of Silver Halide Emulsion

A silver halide emulsion used in a first layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide and another aqueous solution of 0.59 mols of silver nitrate in 600 ml of water were concurrently added to the gelatin solution at an equal flow rate over a period of 40 minutes. In this way, there was prepared a monodispersed cubic silver chlorobromide emulsion having an average grain size of 0.35 μm (bromine 80 mol%).

After rinsing with water and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a third layer was prepared as follows.

An aqueous gelatin solution was prepared by dissolving 20 grams of gelatin and 3 grams of sodium chloride in 1000 ml of water and kept at a temperature of 75° C. While fully agitating the gelatin solution, 600 ml of an aqueous solution of sodium chloride and potassium bromide, another aqueous solution of 0.59 mols of silver nitrate in 600 ml of water, and a dye solution containing 160 ml of dye (I) shown below in 400 ml of methanol were concurrently added to the gelatin solution at an equal flow rate over a period of 40 minutes. In this way, there was prepared a monodispersed cubic silver chlorobromide emulsion having an average grain size of 0.35 μm (bromine 80 mol%).

Dye (I) — 160 ml

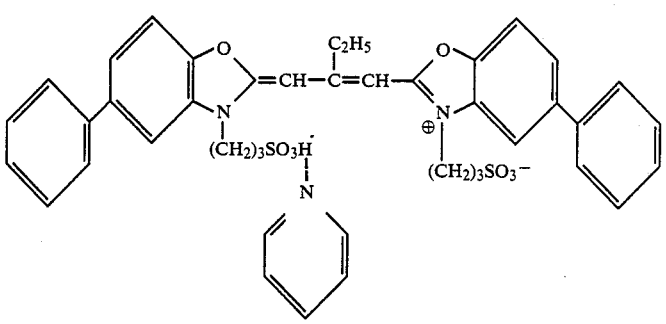

methanol — 400 ml

After water rinsing and desalting, 5 mg of sodium thiosulfate and 20 mg of 4-hydroxy-6-methyl-1,3,3a,7-tetraazaindene were added to effect chemical sensitization at 60° C. There was obtained an emulsion in a yield of 600 grams.

A silver halide emulsion used in a fifth layer was prepared as follows.

An aqueous gelatin solution was prepared by dissolving 20 grams of gelatin and ammonia in 1000 ml of water and kept at a temperature of 50° C. The gelatin solution, 1000 ml of an aqueous solution of potassium iodide and potassium bromide and a silver nitrate solution containing 1 mol of silver nitrate in 1000 ml of water were concurrently added to the fully agitated gelatin solution while keeping the pAg constant. In this way, there was prepared a monodispersed octahedral silver iodobromide emulsion having an average grain size of 0.5 μm (iodine 5 mol%).

After rinsing with water and desalting, 5 mg of chloroauric acid and 2 mg of sodium thiosulfate were added to effect gold and sulfur sensitization at 60° C. There was obtained an emulsion in a yield of 1000 grams.

Next, a dispersion of a dye-providing substance in gelatin was prepared as follows.

Preparation of Gelatin Dispersion of Dye-Providing Substance

Yellow dye-providing substance (29) previously listed in the present specification, 2.6 grams, was dissolved together with 1.7 grams of electron donor ED- (1) having the following structure and 1.5 grams of a high-boiling solvent having the following structure in 8 ml of cyclohexanone by heating at about 60° C., obtaining a homogeneous solution. The solution was mixed with 20 grams of a 10 wt% limetreated gelatin solution, 0.3 grams of sodium dodecylbenzene sulfonate, and 12 ml of water by agitation, and the mixture was dispered with a homogenizer for 10 minutes at 10,000 rpm. This dispersion is called yellow dye-providing substance dispersion.

Electron donor ED-(1)

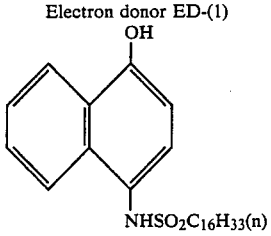

High-boiling solvent

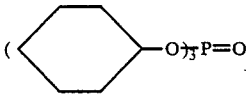

Magenta and cyane dye-providing substance dispersions were prepared by the same procedure as above except that 3.5 grams of magneta dye-providing substance (30) and 3.3 grams of cyan dye-providing substance (31) were respectively used as the dye-providing substance.

Using these preparations, there was prepared a color photosensitive material No. 101 of multi-layer structure as shown in the following formulation, Table 1.

TABLE 1

| FORMULATION |
|---|
| Sixth layer |
| gelatin (coating weight 800 mg/m$^2$) |
| hardener*6 (coating weight 100 mg/m$^2$) |
| silica*5 (coating weight 100 mg/m$^2$) |
| zinc hydroxide*7 (coating weight 300 mg/m$^2$) |
| Fifth layer: Blue-sensitive emulsion layer |
| silver iodobromide emulsion (iodine 5 mol %, coating weight 500 mg/m$^2$ of Ag) |
| yellow dye-providing substance (29) (coating weight 550 mg/m$^2$) |
| gelatin (coating weight 1200 mg/m$^2$) |
| electron donor ED-(1) (coating weight 370 mg/m$^2$) |
| electron transfer agent ETA-(1)*8 (coating weight 25 mg/m$^2$) |
| AF-13 (coating weight 190 mg/m$^2$) |
| high-boiling solvent*4 (coating weight 317 mg/m$^2$) |
| surface-active agent*2 (coating weight 100 mg/m$^2$) |
| Fourth layer: Intermediate layer |
| gelatin (coating weight 800 mg/m$^2$) |
| zinc hydroxide*7 (coating weight 300 mg/m$^2$) |
| Third layer: Green-sensitive emulsion layer |
| silver chlorobromide emulsion (bromine 80 mol %, coating weight 350 mg/m$^2$ of Ag) |
| magenta dye-providing substance (30) (coating weight 400 mg/m$^2$) |
| gelatin (coating weight 1000 mg/m$^2$) |
| electron donor ED-(1) (coating weight 200 mg/m$^2$) |
| electron transfer agent ETA-(1)*8 (coating weight 25 mg/m$^2$) |
| AF-13 (coating weight 103 mg/m$^2$) |
| high-boiling solvent*4 (coating weight 171 mg/m$^2$) |
| surface-active agent*2 (coating weight 100 mg/m$^2$) |
| Second layer: Intermediate layer |
| gelatin (coating weight 800 mg/m$^2$) |
| zinc hydroxide*7 (coating weight 300 mg/m$^2$) |
| First layer: Red-sensitive emulsion layer |
| silver chlorobromide emulsion (bromine 80 mol %, coating weight 350 mg/m$^2$ of Ag) |

TABLE 1-continued

| FORMULATION |
|---|
| sensitizing dye*3 (coating weight 8 × 10$^{-7}$ mol/m$^2$) |
| cyan dye-providing substance (31) (coating weight 400 mg/m$^2$) |
| gelatin (coating weight 1000 mg/m$^2$) |
| electron donor ED-(1) (coating weight 212 mg/m$^2$) |
| electron transfer agent ETA-(1)*8 (coating weight 25 mg/m$^2$) |
| AF-13 (coating weight 109 mg/m$^2$) |
| high-boiling solvent*4 (coating weight 182 mg/m$^2$) |
| surface-active agent*2 (coating weight 100 mg/m$^2$) |
| Support*1 |

*1polyethylene terephthalate of 100 μm thick

*2

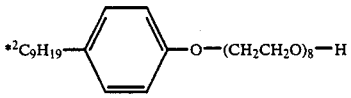

*3

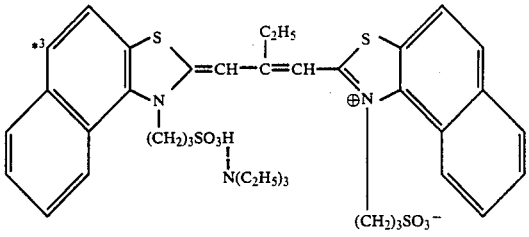

*4

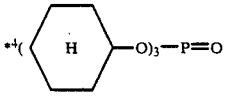

*5size 4 μm

*61,2-bis(vinylsulfonylacetamide)ethane

*7size 0.2 μm

*8ETA-(1)

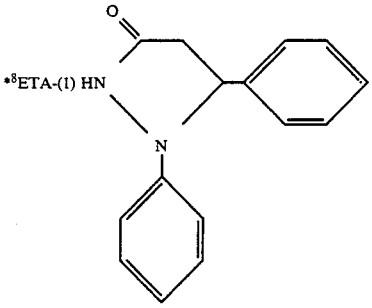

Photosensitive material No. 102 was prepared by repeating the procedure of photosensitive material No. 101 except that electron donor ED-(1) was replaced by an equimolar amount of electron donor ED-(2).

Photosensitive material No. 103 was prepared by repeating the procedure of photosensitive material No. 102 except that electron transfer agent ETA-(1) was replaced by an equimolar amount of electron transfer agent precursor ETA-(2).

Electron donor ED-(2)

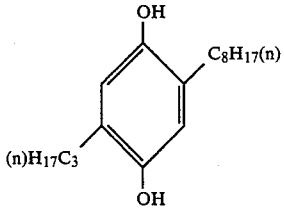

Electron transfer agent precursor ETA-(2)

-continued

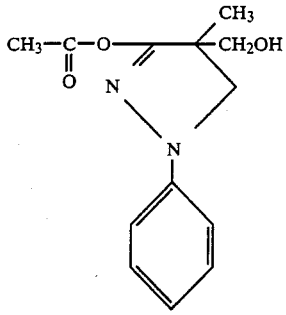

Next, the preparation of a dye-fixing material (R-1) will be described.

Preparation of Dye-Fixing Material

In 1300 ml of water were dissolved 63 grams of gelatin, 130 grams of a polymeric mordant having the structure as defined below, and 80 grams of guanidium picolinate. The solution was uniformly spread onto a paper substrate laminated with polyethylene to a wet film thickness of 45 μm, and then dried.

Mordant:

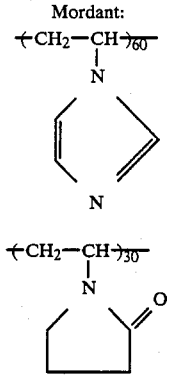

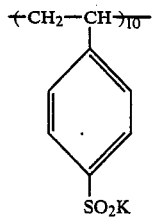

A solution of 35 grams of gelatin and 1.05 grams of 1,2-bis(vinylsulfonylacetamideethane) in 800 ml of water was coated on the mordant layer to a wet film thickness of 17 μm. After drying, there was obtained a dye-fixing material designated R-1.

Each of the multilayered color photosensitive materials prepared above was exposed for one second at 2000 lux under a tungsten lamp through color separation filters B, G, R, and grey having a continuously varying density.

Water was applied by means of a wire bar in an amount of 15 ml per square meter to the emulsion surface of the exposed photosensitive material, which was superimposed on dye-fixing material R-1 such that their effective surfaces faced one another. After heating for 20 seconds through heat rollers at such a temperature that the temperature of the wet film reached 90° C., the dye-fixing material was peeled from the photosensitive material. This treatment is designated Treatment A.

In another run, water was applied in an amount of 15 ml per square meter to the emulsion surface of the exposed photosensitive material, which was superimposed on the dye-fixing material such that their effective surfaces faced one another. They were kept in intimate contact for 20 seconds at room temperature. After similarly heating at 90° C. for 20 seconds, the dye-fixing material was peeled from the photosensitive material. This treatment is designated Treatment B.

Treatment B was repeated except that instead of the 20-second intimate contact at room temperature, the superposed materials were preheated for 10 seconds by means of heat blocks such that the temperature of the wet film reached 50° C. This treatment is designated Treatment C.

In all the treatments, the dye-fixing materials bore thereon clear images of blue, green, red and grey corresponding to the color separation filters of B, G, R and grey. The maximum density (Dmax) and minimum density (Dmin) of cyan, magenta, and yellow colors of the grey portion were measured. The results are shown in Table 2.

TABLE 2

| Photosensitive material | | Treatment A Dmax | A Dmin | B Dmax | B Dmin | C Dmax | C Dmin |
|---|---|---|---|---|---|---|---|
| 101 | Yellow | 2.20 | 0.35 | 2.24 | 0.24 | 2.26 | 0.24 |
| | Magenta | 2.05 | 0.35 | 2.06 | 0.26 | 2.10 | 0.26 |
| | Cyan | 2.00 | 0.38 | 2.00 | 0.26 | 2.03 | 0.25 |
| 102 | Yellow | 2.31 | 0.20 | 2.35 | 0.15 | 2.36 | 0.16 |
| | Magenta | 2.10 | 0.22 | 2.11 | 0.16 | 2.13 | 0.16 |
| | Cyan | 2.02 | 0.22 | 2.04 | 0.18 | 2.05 | 0.18 |
| 103 | Yellow | 2.30 | 0.33 | 2.32 | 0.23 | 2.32 | 0.24 |
| | Magenta | 2.15 | 0.30 | 2.15 | 0.22 | 2.16 | 0.23 |
| | Cyan | 2.10 | 0.35 | 2.12 | 0.25 | 2.13 | 0.26 |

As seen from Table 2, Dmin is lowered and image discrimination is improved by maintaining a photosensitive material and a dye-fixing material with their effective film surfaces in intimate contact at a temperature lower than the heat-developing temperature by at least 10° C. for a certain time before conducting ordinary heat development.

EXAMPLE 2

Color photosensitive material No. 201 of the formulation shown in Table 3 was prepared using the same emulsions, dye-providing substance, and electron donor as used for photosensitive material No. 102 in Example 1.

An organic silver salt emulsion was prepared by dissolving 20 grams of gelatin and 5.9 grams of 4-acetylaminophenylpropiolic acid in 1000 ml of 0.1% sodium hydroxide aqueous solution and 200 ml of ethanol. The solution was agitated at 40° C. To the solution was added 4.5 grams of silver nitrate in 200 ml of water over a period of 5 minutes. The dispersion was pH adjusted such that an excess salt precipitated. After removal of the precipitate and pH adjustment to 6.3, there was obtained an organic silver salt dispesion in a yield of 300 grams.

TABLE 2

| FORMULATION |
|---|
| Sixth layer |
| gelatin (coating weight 100 mg/m$^2$) |
| base precursor*3 (coating weight 500 mg/m$^2$) |
| hardener*6 (coating weight 100 mg/m$^2$) |
| Fifth layer: Blue-sensitive emulsion layer |
| silver iodobromide emulsion (iodine 5 mol %, coating weight 500 mg/m$^2$ of Ag) |
| dimethylsulfamide (coating weight 180 mg/m$^2$) |
| organic silver salt emulsion (coating weight 100 mg/m$^2$ of Ag) |
| base precursor*3 (coating weight 200 mg/m$^2$) |
| yellow dye-providing substance (29) (coating weight 550 mg/m$^2$) |
| gelatin (coating weight 1300 mg/m$^2$) |
| ED-(2) (coating weight 370 mg/m$^2$) |
| ETA-(1) (coating weight 50 mg/m$^2$) |
| AF-13 (coating weight 190 mg/m$^2$) |
| high-boiling solvent*4 (coating weight 800 mg/m$^2$) |
| surface-active agent*2 (coating weight 100 mg/m$^2$) |
| Fourth layer: Intermediate layer |
| gelatin (coating weight 1200 mg/m$^2$) |
| base precursor*7 (coating weight 500 mg/m$^2$) |
| Third layer: Green-sensitive emulsion layer |
| silver chlorobromide emulsion (bromine 80 mol %, coating weight 300 mg/m$^2$ of Ag) |
| dimethylsulfamide (coating weight 180 mg/m$^2$) |
| organic silver salt emulsion (coating weight 100 mg/m$^2$ of Ag) |
| ED-(2) (coating weight 200 mg/m$^2$) |
| base precursor*3 (coating weight 200 mg/m$^2$) |
| ETA-(1) (coating weight 50 mg/m$^2$) |
| magenta dye-providing substance (30) (coating weight 400 mg/m$^2$) |
| gelatin (coating weight 1200 mg/m$^2$) |
| AF-13 (coating weight 103 mg/m$^2$) |
| high-boiling solvent*4 (coating weight 600 mg/m$^2$) |
| surface-active agent*2 (coating weight 100 mg/m$^2$) |
| Second layer: Intermediate layer |
| gelatin (coating weight 1000 mg/m$^2$) |
| base precursor*7 (coating weight 500 mg/m$^2$) |
| First layer: Red-sensitive emulsion layer |
| silver chlorobromide emulsion (bromine 80 mol %, coating weight 300 mg/m$^2$ of Ag) |
| benzenesulfamide (coating weight 180 mg/m$^2$) |
| organic silver salt (coating weight 100 mg/m$^2$ of Ag) |
| sensitizing dye*5 (coating weight $8 \times 10^{-7}$ mol/m$^2$) |
| base precursor*3 (coating weight 200 mg/m$^2$) |
| ED-(2) (coating weight 212 mg/m$^2$) |
| ETA-(1) (coating weight 50 mg/m$^2$) |
| AF-13 (coating weight 109 mg/m$^2$) |
| cyan dye-providing substance (31) (coating weight 300 mg/m$^2$) |
| gelatin (coating weight 1200 mg/m$^2$) |
| high-boiling solvent*4 (coating weight 450 mg/m$^2$) |
| surface-active agent*2 (coating weight 100 mg/m$^2$) |

TABLE 2-continued

| FORMULATION |
|---|
| Support*1 |

*1polyethylene terephthalate film of 100 μm thick

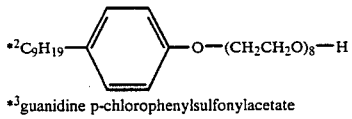

*3guanidine p-chlorophenylsulfonylacetate

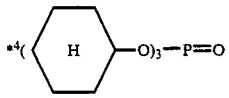

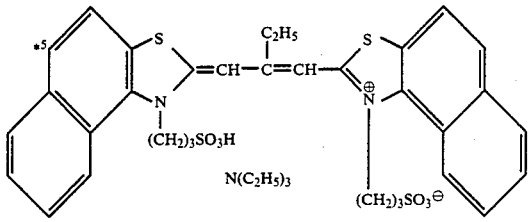

*61,2-bis(vinylsulfonylacetamide)ethane
*7guanidine trichloroacetate

A dye-fixing material R-2 having an image-receiving layer was prepared.

First, 10 grams of poly(methyl acrylate-co-N,N,N-trimethyl-n-vinylbenzyl ammonium chloride) having a ratio of methyl acrylate to vinylbenzyl ammonium chloride of 1:1 was dissolved in 200 ml of water. The solution was homogeneously mixed with 100 grams of 10% lime-treated gelatin and then combined with a hardener. The mixture was evenly spread on a paper substrate laminated with polyethylene having titanium dioxide dispersed therein, thereby forming a layer having a uniform wet thickness of 90 μm. Drying resulted in dye-fixing material R-2 having a mordant layer.

The photosensitive material No. 201 was exposed in the same manner as in Example 1 and then evenly heated on a heat block at 150° C. for 20 seconds.

Water was supplied on the layer surface of dye-fixing material R-2 in an amount of 20 ml per square meter. The photosensitive material which had been heat treated was placed on the dye-fixing material such that their effective surfaces faced each other.

The assembly was heated on a heat block at 80° C. for 6 seconds. The dye-fixing material was peeled from the photosensitive material to find that the dye-fixing material bore a color image thereon. This treatment is designated Treatment D.

Treatment D was repeated except that the exposed photosensitive material was preheated at 100° C. for 10 seconds before it was heated at 150° C. for 20 seconds. After being peeled from the photosensitive material, the dye-fixing material bore a color image thereon. This treatment is designated Treatment E.

The measured photographic properties are shown in Table 4.

TABLE 4

| | Treatment D | | Treatment E | |
|---|---|---|---|---|
| | Dmax | Dmin | Dmax | Dmin |
| Cyan | 2.30 | 0.20 | 2.30 | 0.16 |
| Magenta | 2.10 | 0.20 | 2.12 | 0.16 |
| Yellow | 2.02 | 0.24 | 2.05 | 0.19 |

It is evident that preheating results in a more clearly discriminatable image.

EXAMPLE 3

An internal latent image type silver halide was prepared by adding an aqueous solution of potassium bromide and an aqueous solution of silver nitrate to an aqueous gelatin solution at 75° C. over a period of about 100 minutes with vigorous stirring. There was obtained an emulsion of silver bromide grains having an average grain size of about 1.3 μm. To the silver bromide grain emulsion were added sodium thiosulfate in an amount of 2.5 mg per mol of silver and potassium chloroaurate in an amount of 1.2 mg per mol of silver. Chemical sensitization was carried out by heating the emulsion at 75° C. for 80 minutes. The chemically sensitized emulsion was further treated for 40 minutes under the same precipitation environment as used in the initial preparation. During the treatment, the grains further grew to a final average grain size of about 1.5 μm.

To the emulsion were added sodium thiosulfate in an amount of 0.34 mg per mol of silver and poly(N-vinylpyrrolidone) in an amount of 68 mg per mol of silver. The emulsion was heated at 60° C. for 60 minutes to carry out chemical sensitization on the grain surface.

Next, a dispersion of a dye-providing substance in gelatin was prepared as follows.

Preparation of Gelatin Dispersion of Dye-Providing Substance

A homogeneous solution was prepared by adding 15 grams of yellow dye-providing substance (1) as previously listed and 7.5 grams of tricyclohexyl phosphate to 30 ml of ethyl acetate and heating the mixture at about 60° C. The solution was mixed with 100 grams of a 10 wt % lime-treated gelatin solution, 1.5 grams of sodium dodecylbenzenesulfonate and 60 ml of water by agitation, and the mixture was dispersed with a homogenizer for 10 minutes at 10,000 rpm. This dispersion is called yellow dye-providing substance dispersion.

Magenta and cyan dye-providing substance dispersions were prepared by the same procedure as above except that magenta and cyan dye-providing substances (2) and (3) were used.

A gelatin dispersion of a color-mixing preventing agent to be added to an intermediate layer was prepared as follows.

A homogeneous solution was prepared by adding 10 grams of color-mixing preventing agent (A), 0.3 grams of anti-foggant (B), and 2 grams of a high-boiling solvent, all having the structures shown below, to 20 ml of ethyl acetate, and heating the mixture at about 60° C. The solution was mixed with 30 grams of a 10 wt % lime-treated gelatin solution, 0.5 grams of sodium succinic acid-2-ethylhexylethylsulfonate and 18 ml of water by agitation, and the mixture was dispersed with a homogenizer for 10 minutes at 10,000 rpm.

Color-mixing preventing agent (A)

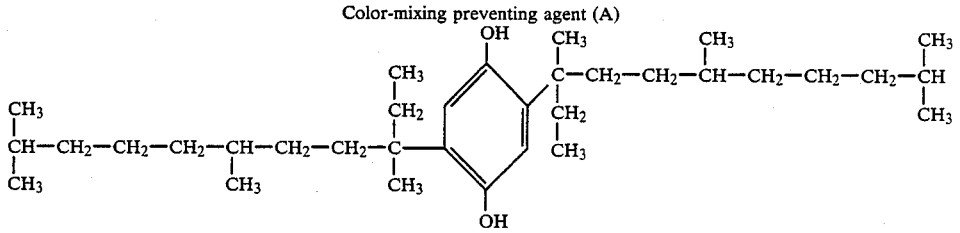

Antifoggant (B)

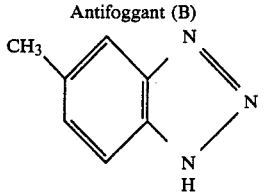

High-boiling solvent

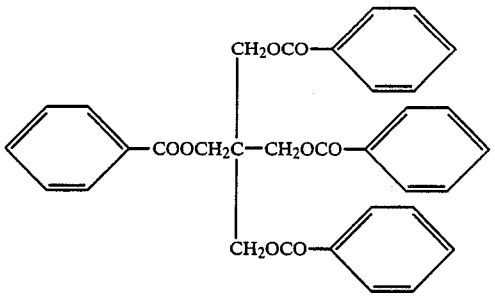

Color photosensitive material No. 301 having the formulation shown in Table 5 was prepared using these dispersions.

TABLE 5

| FORMULATION |
|---|
| Sixth layer: Protective layer |
| gelatin (coating weight 800 mg/m$^2$) |
| hardener*6 (coating weight 100 mg/m$^2$) |
| silica*5 (coating weight 100 mg/m$^2$) |
| Sumikagel-L*10 (coating weight 220 mg/m$^2$) |
| Fifth layer: Blue-sensitive emulsion layer |
| internal latent image type silver bromide emulsion (coating weight 600 mg/m$^2$ of Ag) |
| yellow dye-providing substance (1) (coating weight 450 mg/m$^2$) |

TABLE 5-continued

FORMULATION gelatin (coating weight 1200 mg/m$^2$)

auxiliary developing agent*8 (coating weight 25 mg/m$^2$)

high-boiling solvent*4 (coating weight 225 mg/m$^2$)

surface-active agent*2 (coating weight 100 mg/m$^2$)

sodium pentadecylhydroquinonesulfonate (coating weight 60 mg/m$^2$)

nucleating agent*3 (coating weight 0.1 mg/m$^2$)

sensitizing dye (S-1) (coating weight $10^{-6}$ mol/m$^2$)

Fourth layer: Intermediate layer gelatin (coating weight 900 mg/m$^2$)

color-mixing preventing agent (A) (coating weight 500 mg/m$^2$)

antifoggant (B) (coating weight 15 mg/m$^2$)

high-boiling solvent*9 (coating weight 100 mg/m$^2$)

zinc hydroxide*7 (coating weight 500 mg/m$^2$)

Third layer: Green-sensitive emulsion layer internal latent image type silver bromide emulsion (coating weight 400 mg/m$^2$ of Ag)

magenta dye-providing substance (2) (coating weight 400 mg/m$^2$)

gelatin (coating weight 1000 mg/m$^2$)

auxiliary developing agent*8 (coating weight 25 mg/m$^2$)

high-boiling solvent*4 (coating weight 200 mg/m$^2$)

surface-active agent*2 (coating weight 100 mg/m$^2$)

sodium pentadecylhydroquinonesulfonate (coating weight 50 mg/m$^2$)

nucleating agent*3 (coating weight 0.1 mg/m$^2$)

sensitizing dye (S-2) (coating weight $10^{-6}$ mol/m$^2$)

Second layer: Intermediate layer gelatin (coating weight 900 mg/m$^2$)

color-mixing preventing agent (A) (coating weight 500 mg/m$^2$)

antifoggant (B) (coating weight 15 mg/m$^2$)

high-boiling solvent*9 (coating weight 100 mg/m$^2$)

zinc hydroxide*7 (coating weight 500 mg/m$^2$)

First layer: Red-sensitive emulsion layer internal latent image type silver bromide emulsion (coating weight 400 mg/m$^2$ of Ag)

cyan dye-providing substance (3) (coating weight 300 mg/m$^2$)

gelatin (coating weight 1000 mg/m$^2$)

auxiliary developing agent*8 (coating weight 25 mg/m$^2$)

high-boiling solvent*4 (coating weight 150 mg/m$^2$)

surface-active agent*2 (coating weight 100 mg/m$^2$)

sodium pentadecylhydroquinonesulfonate (coating weight 50 mg/m$^2$)

nucleating agent*3 (coating weight 0.1 mg/m$^2$)

sensitizing dye (S-3) (coating weight $10^{-6}$ mol/m$^2$)

TABLE 5-continued

FORMULATION

Support*1

*1polyethylene terephthalate film of 100 μm thick

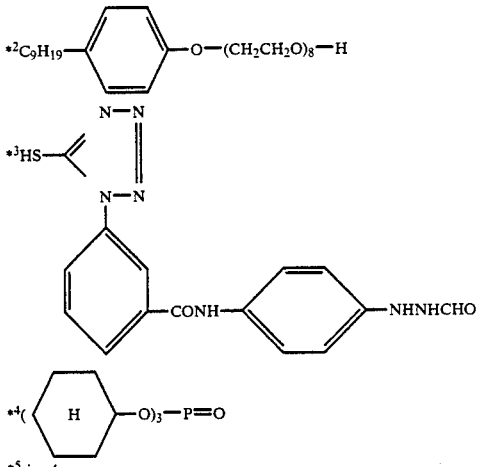

*5size 4 μm
*61,2-bis(vinylsulfonylacetamide)ethane
*7size 0.2 μm
*81,5-diphenyl-3-pyrazolidone

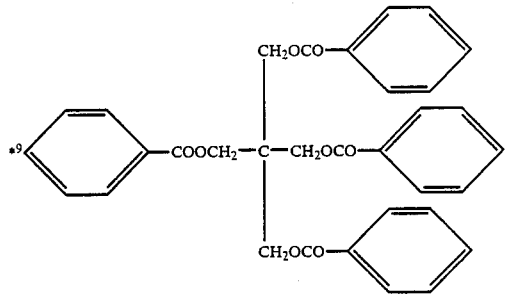

*10trademark of Sumitomo Chemical K.K.

Sensitizing dye S-1

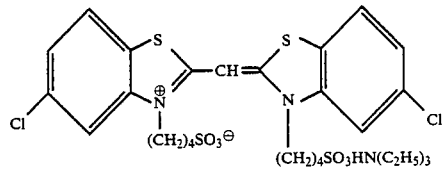

Sensitizing dye S-2

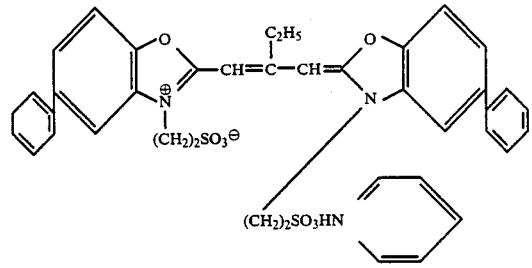

Sensitizing dye S-3

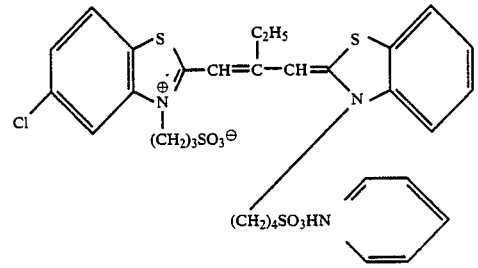

The dye-fixing material used was the same as dye-fixing material R-1 in Example 1.

The procedure of Example 1 was followed to carry out treatments A, B, and C. In all the treatments, the dye-fixing materials bore thereon clear images of blue, green, red and grey corresponding to color separation filters B, G, R and grey. The maximum density (Dmax) and minimum density (Dmin) of cyan, magenta, and yellow colors of the grey portion were measured. The results are shown in Table 6.

TABLE 6

| | Treatment | | | | | |
|---|---|---|---|---|---|---|
| | A | | B | | C | |
| | Dmax | Dmin | Dmax | Dmin | Dmax | Dmin |
| Yellow | 2.00 | 0.38 | 2.18 | 0.27 | 2.20 | 0.25 |
| Magenta | 1.83 | 0.29 | 2.02 | 0.24 | 2.05 | 0.22 |
| Cyan | 1.78 | 0.32 | 1.90 | 0.25 | 1.92 | 0.22 |

As evident from the foregoing data, clear color images can be produced by the image forming method of the present invention.

Obviously, numerous modifications and variations of the present invention are possible in light of the above teachings. It is therefore to be understood that within the scope of the appended claims, the invention may be practiced otherwise than as specifically described herein.

I claim

1. A method for forming an image, comprising the steps of imagewise exposing a heat-developable photosensitive material comprising at least (a) a photosensitive silver halide, (b) a reducing agent or a precursor thereof, (c) a dye-providing substance which forms or releases a diffusible dye in proportion or counter-proportion to the reduction of the silver halide into silver, and (d) a binder on a support, during or after the imagewise exposure of the photosensitive material, maintaining the photosensitive material in such conditions for a predetermined time that the reaction between the silver halide and the reducing agent preferentially takes place rather than the reaction of forming or releasing a diffusible dye, and thereafter heat developing the exposed material in the presence of a base and/or a base precursor to imagewise produce a diffusible dye.

2. The image forming method of claim 1 wherein the photosensitive material is maintained at a temperature lower than the heat-developing temperature above which the reaction of forming or releasing a diffusible dye occurs and under conditions which allow reaction to take place between the silver halide and the reducing agent.

3. The image forming method of claim 2 wherein the photosensitive material is maintained at a temperature sufficient to allow reaction to take place between the silver halide and the reducing agent.

4. The image forming method of claim 2 wherein the photosensitive material is maintained at a temperature lower than the heat-developing temperature by at least 10° C.

5. The image forming method of claim 1 wherein imageforming reaction is carried out in the presence of an auxiliary developing agent.

6. The image forming method of claim 1 wherein an internal latent image type emulsion of the silver halide is combined with a nucleating agent or secondary exposure to carry out image-forming reaction.

7. The image forming method of claim 1 wherein the exposed material is heat developed at a temperature of from about 50° C. to about 250° C.

* * * * *